US007134426B2

(12) United States Patent
Uchino et al.

(10) Patent No.: US 7,134,426 B2
(45) Date of Patent: Nov. 14, 2006

(54) FUEL VAPOR TREATMENT DEVICE

(75) Inventors: Masashi Uchino, Saitama (JP); Masaru Nakano, Saitama (JP); Eiji Yamada, Saitama (JP); Hiroyuki Yoshida, Saitama (JP); Hiroaki Okada, Saitama (JP)

(73) Assignee: Mahle Filter Systems Japan Corporation, Tokyo (JP)

( * ) Notice: Subject to any disclaimer, the term of this patent is extended or adjusted under 35 U.S.C. 154(b) by 229 days.

(21) Appl. No.: 10/509,185

(22) PCT Filed: Jul. 14, 2003

(86) PCT No.: PCT/JP03/08920

§ 371 (c)(1),
(2), (4) Date: Sep. 24, 2004

(87) PCT Pub. No.: WO2004/007939

PCT Pub. Date: Jan. 22, 2004

(65) Prior Publication Data

US 2005/0172938 A1 Aug. 11, 2005

(30) Foreign Application Priority Data

Jul. 16, 2002 (JP) ..... 2002-206865
Jul. 9, 2003 (JP) ..... 2003-194096

(51) Int. Cl.
*F02M 37/04* (2006.01)

(52) U.S. Cl. ..... 123/518; 123/519

(58) Field of Classification Search ..... 123/516, 123/518, 519, 520
See application file for complete search history.

(56) References Cited

U.S. PATENT DOCUMENTS

| | | | | |
|---|---|---|---|---|
| 4,543,938 | A * | 10/1985 | Szlaga | 123/514 |
| 5,269,837 | A | 12/1993 | Ohashi et al. | |
| 5,520,156 | A * | 5/1996 | Brunnhofer | 123/516 |
| 5,875,765 | A * | 3/1999 | Norton | 123/520 |
| 6,273,070 | B1 * | 8/2001 | Arnal et al. | 123/519 |
| 6,460,516 | B1 | 10/2002 | Kimoto et al. | |
| 6,928,990 | B1 * | 8/2005 | Meiller et al. | 123/519 |
| 2004/0226439 | A1 * | 11/2004 | Heim et al. | 95/143 |

FOREIGN PATENT DOCUMENTS

| | | |
|---|---|---|
| EP | 1 113 163 A2 | 7/2001 |
| JP | 2002-30998 A | 1/2002 |

* cited by examiner

*Primary Examiner*—Thomas Moulis
(74) *Attorney, Agent, or Firm*—Foley & Lardner LLP

(57) ABSTRACT

A fuel vapor treatment device for suppressing emission of fuel vapor from a fuel tank or the like of an automotive vehicle. The fuel vapor treatment device comprises a casing having a charge port connected to a fuel tank, a purge port connected to an intake section of an engine, and an atmospheric air port through which atmospheric air is introduced. Fuel vapor adsorbing material is filled in the casing. Additionally, an adsorbing material cartridge is disposed in a part of the casing and includes a cylindrical cartridge main body section having a cross-sectional area smaller than that of the casing. Fuel vapor adsorbing material is filled in the cartridge main body section. Air introduced from the atmospheric air port is flowable through the inside of the cartridge main body section to the fuel vapor adsorbing material in the casing.

13 Claims, 16 Drawing Sheets

FUEL VAPOR TREATMENT DEVICE

TECHNICAL FIELD

This invention relates to improvements in a fuel vapor treatment device configured to adsorb fuel vapor from a fuel tank and the like of an automotive vehicle and release the adsorbed fuel to be combusted in an engine during operation of the engine.

BACKGROUND ART

The fuel vapor treatment device of this type is disclosed in Japanese Patent Provisional Publication No. 2002-30998 and will be discussed with reference to FIG. 18. The fuel vapor treatment device includes a casing 1 which has a charge port 3 connected to a fuel tank 2, a purge port 3 connected to an intake manifold 5 of an engine 4, and an atmospheric air port communicated with atmospheric air. During stopping of the engine, gas containing fuel vapor (fuel component) is introduced from the charge port 3 into the casing. Fuel vapor adsorbing material 8 such as activated carbon is filled in the casing 1 so as to adsorb or remove fuel vapor in the gas. The gas from which fuel vapor has been removed is released through the atmospheric air port 7 to atmospheric air. When the engine is operated from the above condition, fuel vapor in the fuel vapor adsorbing material 8 is sucked through the purge port 6 into the intake side of the engine to be combusted in the engine. At this time, the fuel vapor in the fuel vapor adsorbing material 8 is purged under the action of atmospheric air introduced through the atmospheric air port 7.

The inside of the casing 1 is divided by a partition wall 9 into a first charging chamber 10 communicated with the charge port 3 and the purge port 6 and a second charging chamber 11 communicated with the atmospheric air port 7. The end sections of the first and second charging chambers 10, 11 are communicated with each other through a communication passage 12 thereby forming a generally U-shaped gas passage within the casing 1. The first charging chamber 10 is defined by oppositely disposed filters 13, 14 and filled with the fuel vapor adsorbing material 8. The second charging chamber 11 is defined by oppositely disposed filters 15, 17, and further divided into two chambers by a filter 16 disposed between the filters 15, 17. The two chambers in the second charging chamber 11 are filled with the fuel vapor adsorbing material 8. Accordingly, fuel vapor introduced through the charge port 3 into the casing 1 is mainly adsorbed by the fuel vapor adsorbing material 8 in the first charging chamber 10, and then the remaining part of the fuel vapor is introduced through the communication passage 12 to the fuel vapor adsorbing material 8 within the second charging chamber 11 to be adsorbed by the fuel vapor adsorbing material 8.

Such a conventional fuel vapor treatment device is provided for the purpose of reducing emission of fuel vapor in the fuel tank into atmospheric air. However, in the recent years, a regulation for emission control of fuel vapor to atmospheric air has become more strict, and therefore it has been required to further lower the emission amount of fuel vapor to atmospheric air. In this regard, it has been known that it is effective to increase a ratio (L/D value) of the length (L) of a layer of the fuel vapor adsorbing material to the diameter (D) of an effective cross-sectional area of the layer in order to reduce emission of fuel vapor to atmospheric air. In this regard, study has been made to increase the L/D value.

In the above conventional fuel vapor treatment device, increasing the L/D value is taken into consideration; however, in order to sufficiently increase the L/D value, a new design for the whole casing of the fuel vapor treatment device is necessary thereby unavoidably increasing a production cost of the fuel vapor treatment device.

Additionally, there is now a requirement of separately producing a plurality of fuel vapor treatment devices which have different specifications to provide different L/D values. To meet this requirement, it is necessary to prepare a plurality of production equipments for separately produce a plurality of different casings, thereby providing the fear of lowering the production efficiency of the fuel vapor treatment devices.

DISCLOSURE OF INVENTION

It is, therefore, an object of the present invention to provide an improved fuel vapor treatment device which can effectively overcome drawbacks encountered in conventional fuel vapor treatment devices.

Another object of the present invention is to provide an improved fuel vapor treatment device which can effectively achieve both a sufficient reduction of emission of fuel vapor to atmospheric air and a high production efficiency for the fuel vapor treatment device.

A further object of the present invention is to provide an improved fuel vapor treatment device whose L/D value can be easily changed without making a design change of the whole body of a casing of the fuel vapor treatment device.

An aspect of the present invention resides in a fuel vapor treatment device which comprises a casing having a charge port connected to a fuel tank, a purge port connected to an intake section of an engine, and an atmospheric air port through which atmospheric air is introduced, the casing including a part adjacent the atmospheric air port. Fuel vapor adsorbing material filled in the casing. Additionally, an adsorbing material cartridge is disposed in the part of the casing and formed separate from the casing. The adsorbing material cartridge includes fuel vapor adsorbing material. Air introduced from the atmospheric air port is flowable through the fuel vapor adsorbing material of the adsorbing material cartridge to the fuel vapor adsorbing material in the casing.

Another aspect of the present invention resides in a fuel vapor treatment device which comprises a casing having a charge port connected to a fuel tank, a purge port connected to an intake section of an engine, and an atmospheric air port through which atmospheric air is introduced. The casing includes a part adjacent the atmospheric air port. Fuel vapor adsorbing material is filled in the casing. Additionally, an adsorbing material cartridge is disposed in the part of the casing and includes a cylindrical cartridge main body section having a cross-sectional area defined by an outer periphery of the cartridge main body section, smaller than a cross-sectional area defined by an inner periphery of the casing. The adsorbing material cartridge has first and second end portions which are opposite to each other. The first end portion is closer to the atmospheric air port than the second end portion. The first and second end portions are formed respectively with first and second openings, air introduced from the atmospheric air port being flowable through the first and second openings to the fuel vapor adsorbing material in the casing. Fuel vapor adsorbing material is filled in the cartridge main body section.

A further aspect of the present invention resides in a fuel vapor treatment device which comprises a casing including first and second casing sections, the first casing section having a charge port connected to a fuel tank, and a purge port connected to an intake section of an engine, the second casing section having an atmospheric air port through which atmospheric air is introduced. Fuel vapor adsorbing material is filled in the first and second casing sections of the casing. An adsorbing material cartridge is disposed in a part of the second casing section which part is adjacent the atmospheric air port. The adsorbing material cartridge includes a cylindrical cartridge main body section having a cross-sectional area defined by an outer periphery of the cartridge main body section, smaller than a cross-sectional area defined by an inner periphery of the part of the second casing section. The adsorbing material cartridge has first and second end portions which are opposite to each other. The first end portion is closer to the atmospheric air port than the second end portion. The first and second end portions are formed respectively with first and second openings, air introduced from the atmospheric air port being flowable through the first and second openings to the fuel vapor adsorbing material in the first and second casing sections. Fuel vapor adsorbing material is filled in the cartridge main body section. Additionally, a cylindrical air guide member is fixedly disposed outside a major part of the cartridge main body section and having first and second end portions which are opposite to each other and located respectively adjacent the first and second end portions of the cartridge main body section. The first end portion of the air guide member is fixed to the second casing section and formed with an opening in which the cartridge main body section is located. The second end portion of the air guide member is closed so as to define a space between the air guide member and the cartridge main body section, the space being in communication with the inside of the cartridge main body section and with the inside of the second casing section.

A still further aspect of the present invention resides in a fuel vapor treatment device which comprises a casing including first and second casing sections, the first casing section having a charge port connected to a fuel tank, and a purge port connected to an intake section of an engine, the second casing section having an atmospheric air port through which atmospheric air is introduced. Fuel vapor adsorbing material is filled in the first and second casing sections of the casing. A cylindrical wall section extends from a part of the second casing section which part is adjacent the atmospheric air port into the second casing section. The cylindrical wall section has a first end portion connected to the part of the second casing section, and a second end portion through which air is flowable. The cylindrical wall section has a cross-sectional area defined by an outer periphery of the cylindrical wall section, smaller than a cross-sectional area defined by an inner periphery of the part of the second casing section. An adsorbing material cartridge is disposed inside the cylindrical wall section, air introduced from the atmospheric air port being flowable through the adsorbing material cartridge to the second end portion of the cylindrical wall section. Additionally, a cylindrical air guide member is fixedly disposed outside a major part of the cylindrical wall section and having first and second end portions which are opposite to each other and located respectively adjacent the first and second end portions of the cylindrical wall section. The first end portion of the air guide member is fixed to the second casing section and formed with an opening in which the cylindrical wall section is located. The second end portion of the air guide member is closed so as to define a space between the air guide member and the cylindrical wall section, the space being in communication with the inside of the cylindrical wall section and with the inside of the second casing section.

BRIEF DESCRIPTION OF DRAWINGS

In the drawings, like reference numerals designate like parts and elements throughout all figures, in which.

THE BEST MODE FOR CARRYING OUT THE INVENTION

Figure 1:
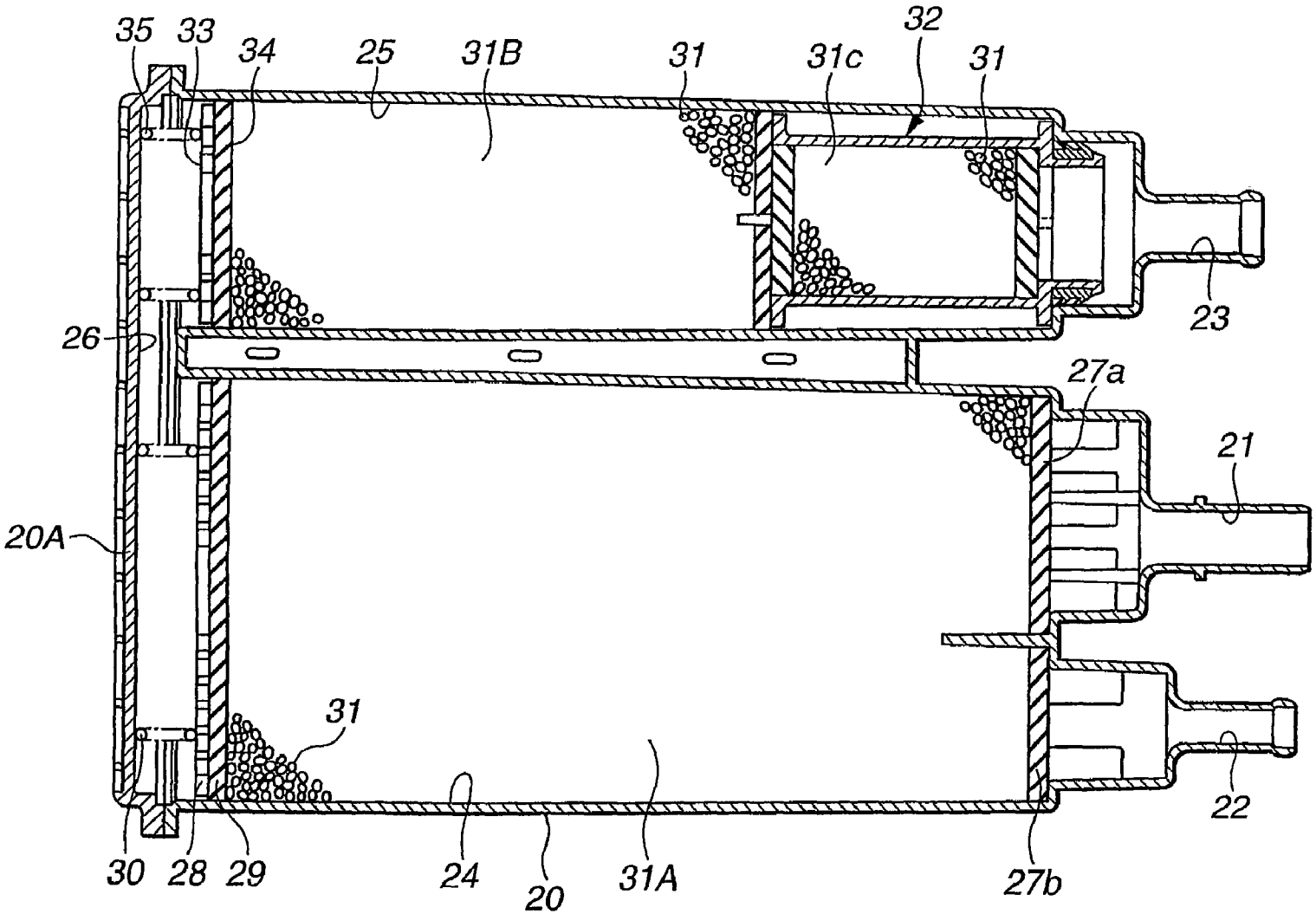
FIG. 1 is a vertical sectional view of a first embodiment of a fuel vapor treatment device according to the present invention.
Figure 2:
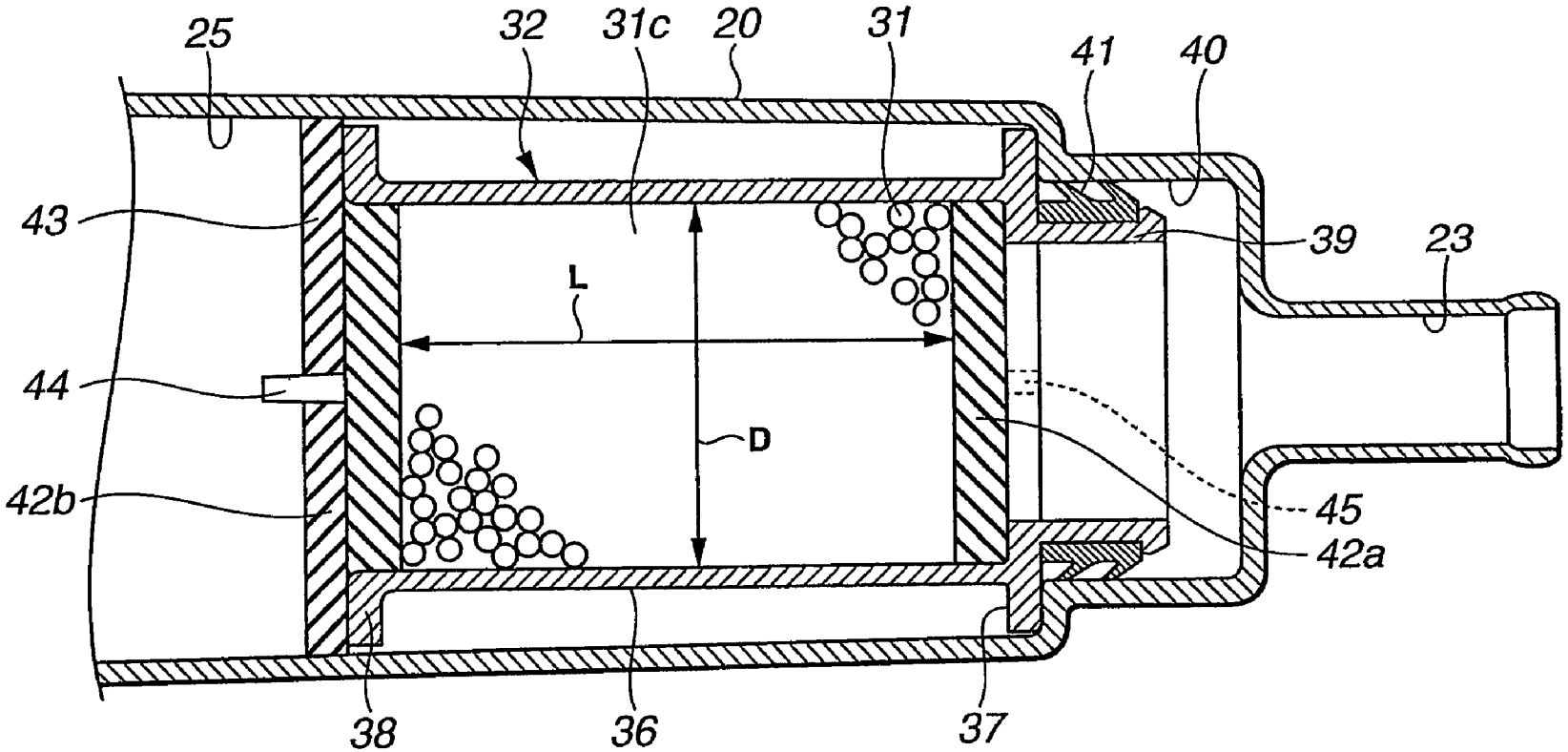
FIG. 2 is a fragmentary enlarged sectional view of an essential part of the fuel vapor treatment device of FIG. 1.
Figure 3:
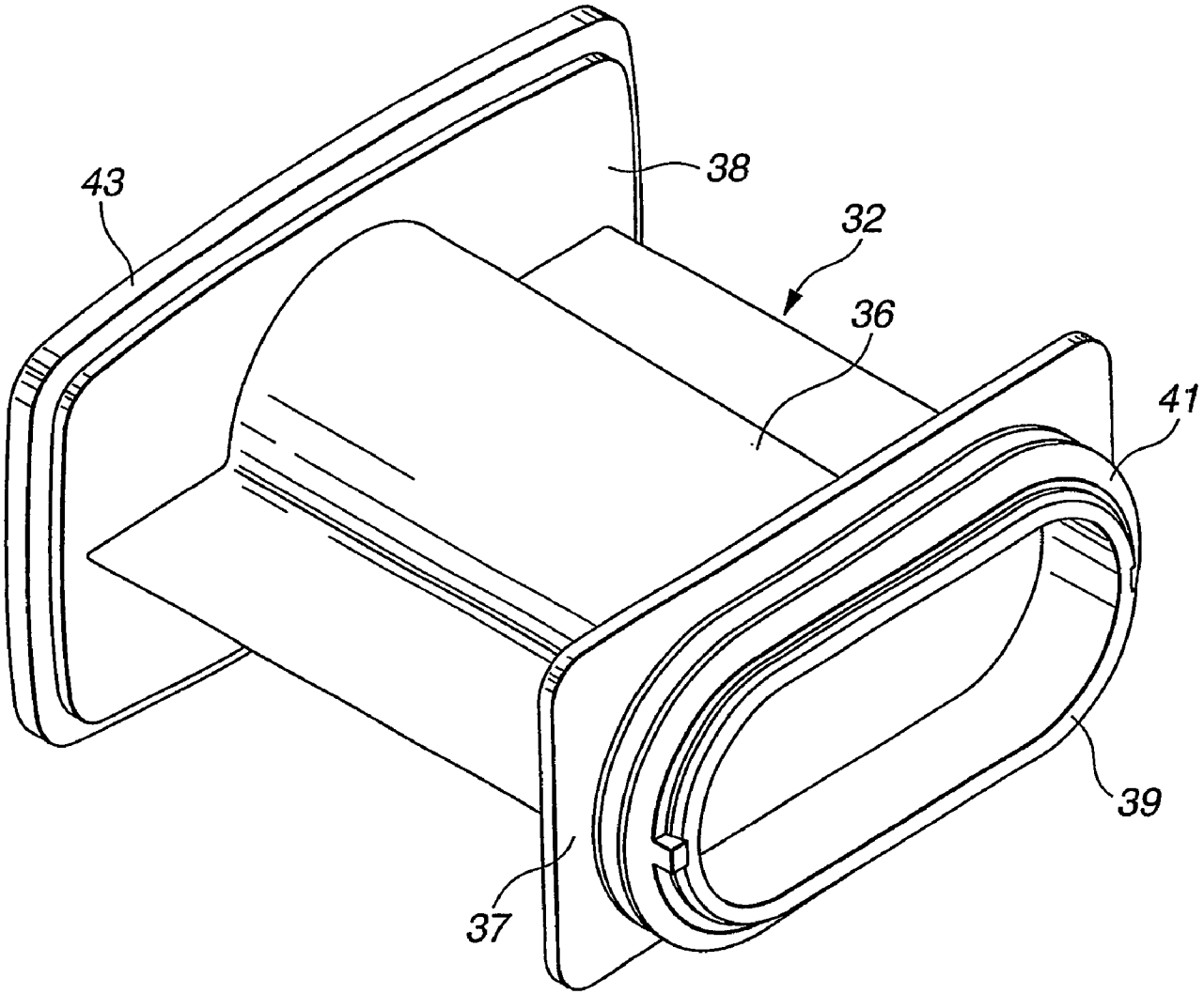
FIG. 3 is an enlarged perspective view of an adsorbing material cartridge of the fuel vapor treatment device of FIG. 1.

Referring now to FIGS. 1 to 3, a first embodiment of a fuel vapor treatment device according to the present invention is illustrated. The vapor treatment device comprises a casing 20 formed of a resin material (synthetic resin). The casing 20 is formed at its one end side with a charge port 21, a purge port 22 and an atmospheric air port 23. The charge port 21 is connected to a fuel tank (not shown) of an automotive vehicle. The purge port 22 is connected to an intake side or system (not shown) of an internal combustion engine (not shown) of the vehicle. The atmospheric air port 23 is communicated with atmospheric air. The inside of the casing 20 is divided into a first charging chamber 24 and a second charging chamber 25. In other words, the casing 20 includes a first casing section (no numeral) defining therein the first charging chamber 24, and a second casing section (no numeral) defining therein the second charging chamber 25. The first charging chamber 24 is communicated with the charge port 21 and the purge port 22. The second charging chamber 25 is communicated with the atmospheric air port 23. Each of first and second charging chambers 24, 25 axially extends and has its first (right-side) and second (left-side) end sections (not identified). The charge port 21 and the purge port 22 are located adjacent the first end section of the first charging chamber 24. The atmospheric air port 23 is located adjacent the first end section of the second charging chamber 25. As shown, the second end sections of the first and second charging chambers 24, 25 are communicated through a communication passage 26 with each other. The communication passage 26 is defined by a cover 20A fixed to the open end portions of the first and second casing sections of the casing 20. Accordingly, a generally U-shaped passage is formed within the casing 20 and includes the first charging chamber 24, the communication passage 26 and the second charging chamber 25 which are connected with each other. The second charging chamber 25 is formed having a cross-sectional area smaller than that of the first charging chamber 24. The cross-sectional area of the second charging chamber 25 is about ½ of the cross-sectional area of the first charging chamber 24.

Filters 27*a* and 27*b* are disposed at the first end section of the first charging chamber 24 and respectively positioned adjacent the charge and purge ports 21, 22. Fuel vapor from charge port 21 is supplied through the filter 27*a* into the first charging chamber 24. Fuel vapor in the first charging chamber 24 is purged through the filter 27*b* from the purge port 22. A filter 29 is disposed at the second end section of the first charging chamber 24 and supported by a porous plate 28 which is slidably fitted to the inner surface of the first casing section and biased in a direction of ports 21, 22 by a spring 30. Activated carbon 31 serving as fuel vapor adsorbing material is filled or charged in the first charging chamber 24 and between the aligned filters 27*a*, 27*b* and the filter 30, forming a first activated carbon layer 31A. The activated carbon 31 is in the shape of particle and formed by pulverizing activated carbon or by forming activated carbon into particle.

An adsorbing material cartridge or unit 32 discussed in detail after is disposed at the first end section of the second fuel vapor charging chamber 25 and located adjacent the atmospheric air port 23. A filter 34 is disposed at the second end section of the second charging chamber 25 and supported by a porous plate 33. The porous plate 33 forms an end wall (at the second end section) together with the filter 34, and is slidably fitted to the inner surface of the second casing section and biased in a direction of atmospheric air port 23 by a spring 35. The activated carbon 31 serving as fuel vapor adsorbing material is filled or charged in the second charging chamber 25 and between the adsorbing material cartridge 32 and the filter 34, forming a second activated carbon layer 31B. Additionally, activated carbon 12 is also filled inside adsorbing material cartridge 13, forming a third activated carbon layer 31C.

Here, in the first activated carbon layer 31A and the second activated carbon layer 31B, the amount of activated carbon filled therein is suitably adjustable in accordance with the specification of the fuel vapor treatment device, because the end wall including the porous plate 28 and the filter 29 and the end wall including the porous plate 33 and the filter 34 are movable upon being biased respectively by the springs 30, 35. The amount of activated carbon filled in the adsorbing material cartridge 32 is fixed and therefore not adjustable.

While each of the first, secondhand third activated carbon layers 31A, 31B and 31C has been shown and described as including only activated carbon in the first embodiment, it will be appreciated that each of the first, second and third activated carbon layers 31A, 31B and 31C may include a heat-accumulative material in addition to the fuel vapor adsorbing material such as activated carbon. The heat-accumulative material may be random mixed with the fuel vapor adsorbing material to be filled in the chamber 24 or 25 or the cartridge 32. Otherwise, the heat-accumulative material and the fuel vapor adsorbing material are respectively formed into layers and disposed alternately to be filled in the chamber 24, 25 or the cartridge 32. Further otherwise, the heat-accumulate material and the fuel vapor adsorbing material may be previously mixed with binder to be formed into particles of a honeycomb-shaped monolithic body which are/is to be filled in the chamber 24, 25 or the cartridge 32. Examples of the heat-accumulative material are aluminum, ceramic and the like which are high in heat conductivity and specific heat.

In case that the heat-accumulative material is filled together with the adsorbing material such as activated carbon in the chamber 24, 25 or the cartridge 32, the adsorbing performance of the fuel vapor adsorbing material can be raised by adsorbing heat of the fuel vapor adsorbing material during adsorption of fuel vapor to the fuel vapor adsorbing material, while the amount of fuel vapor released from the adsorbing material can be increased by suppressing a temperature lowering of the fuel vapor adsorbing material with heat accumulated in the heat-accumulative material during releasing of fuel vapor from the fuel vapor adsorbing material. Although repetition of such explanation will not be made for the purpose of simplicity of illustration in other embodiments which will be discussed after, it will be understood that the heat-accumulative material may be filled in the first charging chamber 24, the second charging chamber 25 and/or the adsorbing material cartridge 32, upon being mixed with the fuel vapor adsorbing material or upon being formed into the particles containing fuel vapor adsorbing material or the honeycomb-shaped monolithic body containing fuel vapor adsorbing material.

Further, the first, second and third activated carbon layers 31A, 31B and 31C may be replaced with a honeycomb-type monolithic (formed) body of the fuel vapors adsorbing material.

As clearly shown in FIGS. 2 and 3, the adsorbing material cartridge 32 includes a cylindrical cartridge main body section 36 which defines therein a charging chamber in which the activated carbon 31 is filled or charged. The cartridge main body section 36 is formed separate and removable from the casing 20. The charging chamber of the cartridge main body section 36 has a cross-sectional area (perpendicular to the axis of the cartridge main body section 36) smaller than that of the second charging chamber 25. The cartridge main body section 36 is integrally provided with first (right-side) flange 37 and second (left-side) flange 38. The first flange 37 radially outwardly extends from the first (right-side) end portion of cartridge main body section 36, and further radially inwardly extends from the first end portion of the cartridge main body section 36 to form an inner flange section (no numeral). In other words, the first flange 37 is perpendicular to the axis of the adsorbing material cartridge 32. The second flange 38 radially outwardly extends from the second (left-side) end portion of the cartridge main body section 36. A cylindrical wall section 39 is formed integral with the inner flange section and axially extends from the inner flange section of the adsorbing material cartridge 32. The second casing section of the casing 20 includes a cylindrical wall section 40 which is formed integral with the main body of the second casing section and is smaller in cross-sectional area than the main body of the second casing section so that a generally annular step portion (no numeral) is formed between the main body of the second casing section and the cylindrical wall section 40. The first flange 37 of the adsorbing material cartridge 32 is in contact with the step portion, and cylindrical wall section 39 of the cartridge 32 is inserted inside the cylindrical wall section 40. A generally annular sealing member or packing material 41 is disposed around the outer peripheral surface of cylindrical wall section 39 so that gas tight seal is established between the outer peripheral surface of cylindrical wall section 39 and the inner peripheral surface of cylindrical wall section 40. The sealing member 41 has a generally U-shaped cross-section so as to have annular seal lips (no numerals) which radially outwardly extend and parallel with each other as seen in FIG. 3. It will be understood that the sealing member 41 may be omitted in which the inner diameter of the cylindrical wall section 40 and the outer diameter of the cylindrical wall section 39 are generally equal to each other, which practically does not any problem. Thus, the adsorbing material cartridge 32 is formed separate and removable from the casing 20.

A first (right-side) filter 42*a* is disposed inside cartridge main body section 17 and located at the first (right-side) end portion of cartridge main body section 36 in such a manner as to be in contact with the inner flange section. Accordingly, the first filter 42*a* is located adjacent atmospheric air port 23 so that the cylindrical wall section 39 is positioned between first filter 42*a* and the atmospheric air port 23. A second (left-side) filter 42*b* is disposed inside the cartridge main body section 36 and located at the second (left-side) end portion of cartridge main body section 36. The activated carbon 31 is filled between the filters 42*a*, 42*b*. These filters 42*a*, 42*b* are formed of polyurethane resin or the like having a flexibility so as to allow a volume change of the third activated carbon layer 31C due to heat or the like. Each of the first and second flanges 37, 38 is formed having an outer peripheral edge portion whose profile corresponds to the inner peripheral shape of the wall section of the second casing section of the casing 20 so that it slidably fits to the inner peripheral surface of the second casing section.

Additionally, a filter 43 formed of a non-woven fabric is welded or fixed to the second flange 38 at a surface facing the second activated carbon layer 31B, thereby damming up and keeping the activated carbon 31 of the second activated carbon layer 31B in position. The filter 43 has an area defined the outer periphery, slightly larger than an area defined by the outer periphery of the second flange 38. Accordingly, when the adsorbing material cartridge 32 is installed into the second charging chamber 25 in such a manner that the second flange 38 is brought into fit with the inner surface of the second casing section defining the second charging chamber 25, the outer peripheral portion of the filter 43 becomes into a slightly compressed condition so as to be deformed under compression and brought into tight fit to the inner wall of the second charging chamber 25. As a result, the activated carbon 31 can be securely prevented from passing though a clearance between the second flange 38 and the inner wall surface defining the second charging chamber 25. In FIG. 2, the reference numeral 44 denotes a support pin which extends from the second flange 38 for the purpose of locating and supporting the filter 43, and the reference numeral 45 denotes a rib which is formed integral with the cartridge main body section 36 and located at the opening (defined inside the first flange 37) for the purpose of supporting the filter 42*a*.

Here, the third activated carbon layer 31C within the adsorbing material cartridge 32 has a L/D value (a ratio between L and D as indicated in FIG. 2) of about 1.5 in which L is the length of the third activated carbon layer 31C, and D is a diameter of the third activated carbon layer 31C in an effective cross-sectional area. The effective cross-sectional area means an area in a plane perpendicular to the axis of the third activated carbon layer 31C which area is practically effective for adsorbing fuel vapor. A variety of tests and experiments have revealed that the L/D value of not smaller than 1.0 is preferable from the viewpoint of preventing fuel vapor from being emitted to atmosphere. In this regard, in this embodiment of the fuel vapor treatment device, the L/D value is set at about 1.5 upon leaving a margin. It will be understood that the L/D value of the whole fuel vapor treatment device is calculated as the sum of respective L/D values of the first, second and third activated carbon layers 31A, 31B, 31C. Accordingly, even in case that the volumes of the first and second activated carbon layers 31A, 31B are changed, the L/D value of the whole fuel vapor treatment device can be always maintained at not less than 1.5 which is the L/D value of the adsorbing material cartridge 32.

Additionally, the volume of activated carbon in the third activated carbon layer 31C is set at about 3% of the total volume of whole activated carbon used in the fuel vapor treatment device. It is preferable that the volume of activated carbon in the third activated carbon layer 31C is preferably not more than 10% of the total volume of the whole activated carbon used in the fuel vapor treatment device even in case that the volumes of the first and second activated carbon layers 31A, 31B are changed.

Hereinafter, operation of the first embodiment of the fuel vapor treatment device will be discussed.

Fuel vapor generated during stopping of the vehicle is introduced through the charge port 21 into the inside of the casing 1 so that fuel vapor is adsorbed by the activated carbon 31. Fuel vapor is a mixture gas which mainly includes hydrocarbons (referred hereinafter to as HC) gas and air. HC gas is adsorbed by the activated carbon 31, while air is released from the atmospheric air port 23 through the first, second and third activated carbon layers 31A, 31B, 31C.

During operation of the engine of the vehicle, atmospheric air is introduced from the atmospheric air port 23 and flows through the third, second and first activated carbon layers 31C, 31B, 31A (in this order), and the purge port 22 so as to be sucked into the engine. At this time, HC gas adsorbed in the activated carbon 31 is purged under the action of air flowing through the activated carbon layers. Purge of HC is transferred from the side of the third activated carbon layer 31C to the side of the first activated carbon layer 31A, in which the thus purged HC gas passes through the purge port 22 and is introduced into the intake section or manifold of the engine so as to be combusted in the engine. The activated carbon 31 is regenerated under such purge of HC so as to revive a fuel vapor adsorbing ability of the activated carbon 31.

Here, a slight amount of HC which has not been able to be purged remains in the activated carbon layers 31A, 31B, 31C, in which such HC is gasified and diffused within the activated carbon layers 31A, 31B, 31C. In this embodiment of the fuel vapor treatment device, the L/D value of the third activated carbon layer 31C in the adsorbing material cartridge 32 is set at about 1.5 so that the L/D value of the whole fuel vapor treatment device is set at not less than 1.5, and therefore diffusion of HC and release of HC into atmospheric air due to the diffusion can be effectively suppressed.

In this embodiment of the fuel vapor treatment device, the volume of the activated carbon 31 in the adsorbing material cartridge 32 is considerably small as about 3% of the volume of the total activated carbon 31 in the whole fuel vapor treatment device, and therefore a ratio (or so-called purge bed volume) of the amount of atmospheric air introduced during engine operation through the third activated carbon layer 31C to the volume of the third activated carbon layer 31C is large. As a result, during engine operation, fuel vapor adsorbed in the third activated carbon layer 31C can be sufficiently purged so that the adsorbed fuel vapor can be securely released. Accordingly, when fuel vapor flows into the fuel vapor treatment device from the fuel tank, HC gas passing through the second activated carbon layer 31B can be securely adsorbed by the third activated carbon layer 31C.

The fuel vapor treatment device of this embodiment is assembled as follows: The adsorbing material cartridge 32 has been previously produced containing therein the activated carbon 31, and inserted into the second charging chamber 25. Then, the filters 27*a*, 27*b* are installed in position in the first charging chamber 24. Thereafter, the activated carbon 31 is filled in the remaining spaces in the first and second charging chambers 24, 25. Then, the filters 29, 34, the porous plates 28, 33 and the springs 30, 35 are disposed in respective positions as shown in FIG. 1. Thereafter, the cover 20A is installed to close the second end sections of the first and second charging chambers 24, 25, maintaining the communication passage 26, followed by welding the peripheral portion of the cover 20A to the casing 20.

While the adsorbing material cartridge 32 has been described as having been previously produced to be assembled in the casing 20 in the above embodiment, it will be understood that the adsorbing material cartridge 32 may not have been previously produced, in which the cartridge main body section 36 provided with the sealing member 41 such as the packing material or the O-ring is disposed inside the cylindrical wall section 40 of the casing 20, followed by supplying other component parts and the activated carbon 31 to the casing 20.

The fuel vapor treatment device of this embodiment is arranged to increase the L/D value of the whole fuel vapor treatment device as discussed above thereby almost completely suppressing emission of a fuel component (HC) into atmospheric air. This improvement can be accomplished by installing the adsorbing material cartridge 32 in the casing 20 which is the almost same as that of a conventional fuel vapor treatment device. In other words, the cross-sectional area of an activated carbon charging section (or the inside of the cartridge main body section 36) of the adsorbing material cartridge 32 is smaller than that of the second charging chamber 25, and therefore the L/D value of the adsorbing material cartridge 32 itself can be readily set larger. Additionally, by installing this adsorbing material cartridge 32 in position, the L/D value of the whole fuel vapor treatment device can be ensured to be not less than the L/D value of the adsorbing material cartridge 32. Furthermore, it is a matter of course that it is possible to produce a fuel vapor treatment device provided with the adsorbing material cartridge 32 and another fuel vapor treatment device provided no adsorbing material cartridge (i.e., the devices different in L/D value) together or alternately in the same production line. Additionally, by installing the adsorbing material cartridges 32 having the different activated carbon layer lengths L and the different effective cross-sectional area diameters D in the casing 20, it can be easily accomplished to provide the fuel vapor treatment devices (including ones provided with no adsorbing material cartridge) which well correspond to the displacements of the engines and to the sizes of the fuel tanks.

Particularly in this embodiment of the fuel vapor treatment device, the cartridge main body section 36 of the adsorbing material cartridge 32 is provided at its opposite end portions with the first and second flanges 37, 38, and the filter 43 forming a supporting wall is welded to the second flange 38 at the surface facing the second activated carbon layer 31B. As a result, upon installing the adsorbing material cartridge 32 in the second charging chamber 25, activated carbon 32 for the second activated carbon layer 31B can be filled in the second charging chamber 25 merely by pouring activated carbon 32 into the second charging chamber 25, thereby raising an assembly efficiency of the fuel vapor treatment device.

In the adsorbing material cartridge 32 of this embodiment, the first and second flanges 37, 38 are brought into fit with the inner wall surface of the second charging chamber 25, and therefore a play of the adsorbing material cartridge 32 after assembly can be suppressed. Additionally, during installation of the adsorbing material cartridge 32, only the first and second flanges 37, 38 having smaller widths are in slidable contact with the inner wall surface of the second charging chamber 25 so as to increase the slidable characteristics of the adsorbing material cartridge 32, thus improving the assembly-operation efficiency of the fuel vapor treatment device.

The adsorbing material cartridge 32 is assembled in the second charging chamber 25 in the following manner: The first flange 37 is brought into contact with the annular step portion integral with the cylindrical wall section 40; the cylindrical wall section 59 is inserted in the cylindrical wall section 40 of the casing 20; and the space between the cylindrical wall sections 39, 40 is filled with the sealing member or packing material 41 having the generally U-shaped cross-section. Accordingly, the fuel component passing through the second activated carbon layer 31B can be prevented from flowing through the outer space around the adsorbing material cartridge 32 to the atmospheric air port 23 without passing through the third activated carbon layer 31C, and atmospheric air introduced from the atmospheric air port 23 can be prevented from flowing into the second activated carbon layer 31B without passing through the third activated carbon layer 31C. As a result, fuel vapor and atmospheric air can be securely introduced into the third activated carbon layer 31C.

Since the amount of fuel vapor vaporized from the fuel tank depends on the size and shape of the fuel tank, the fuel vapor treatment devices different in amount of activated carbon may be used in accordance with the specifications of the fuel tanks in case that the fuel vapor treatment devices are applied to the vehicles having the fuel tanks different in the specifications of the fuel tanks. In this embodiment of the fuel vapor treatment device, the end wall (including the porous plate 28 and the filer 29) of the first charging chamber 24 and the end wall (including the porous plate 33 and the filter 34) of the second charging chamber 25 are respectively biased by the springs 30, 35, and therefore the amount of the activated carbon 31 to be filled in each of the first and second changing chambers 24, 25 can be freely changed or adjusted in accordance with the specification of the fuel tank. Even in this case, the necessary L/D value of the whole fuel vapor treatment device can be securely set by using the adsorbing material cartridge 32. Thus, according to the principle of this embodiment of the fuel vapor treatment device, the fuel vapor treatment devices having a variety of specifications can be readily individually produced without causing fuel vapor emission to atmospheric air over a regulated level.

As appreciated from the above, according to this embodiment, the necessary minimum L/D value of the whole fuel vapor treatment device can be ensured under the effect of the L/D value of the adsorbing material cartridge. The main body section (filled with the adsorbing material) of the adsorbing material cartridge is smaller in cross-sectional area than other adsorbing material charging sections or chambers in the casing, so that D in the L/D value is smaller. Accordingly, the L/D value of the whole fuel vapor treatment device can be easily set larger. This makes it possible to easily change the L/D value of the whole fuel vapor treatment device by installing adsorbing material cartridges having different L/D values without changing the design of the whole body of the casing.

Figure 4:
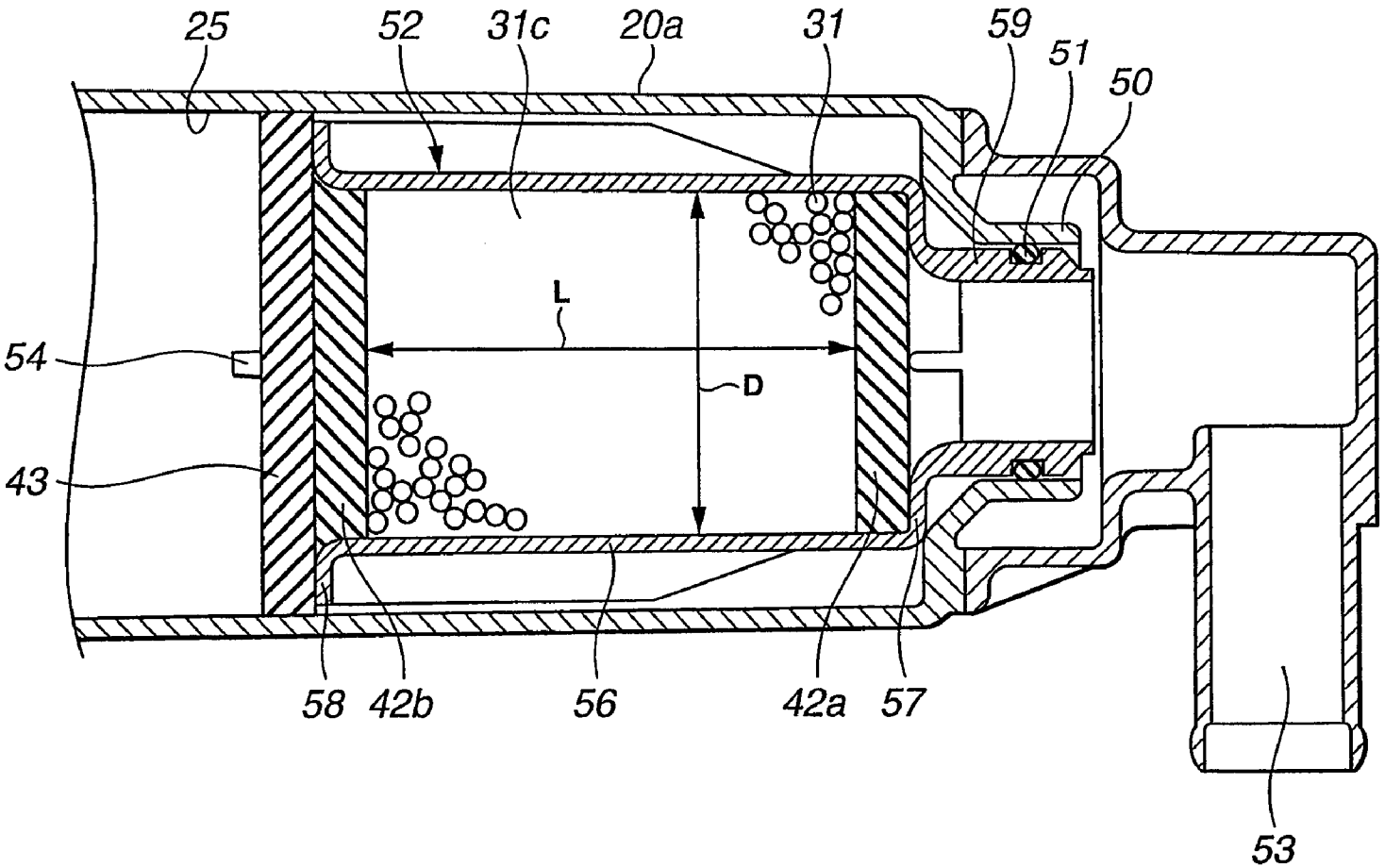
FIG. 4 is a fragmentary enlarged vertical sectional view of an essential part of a second embodiment of the fuel vapor treatment device according to the present invention.
Figure 5:
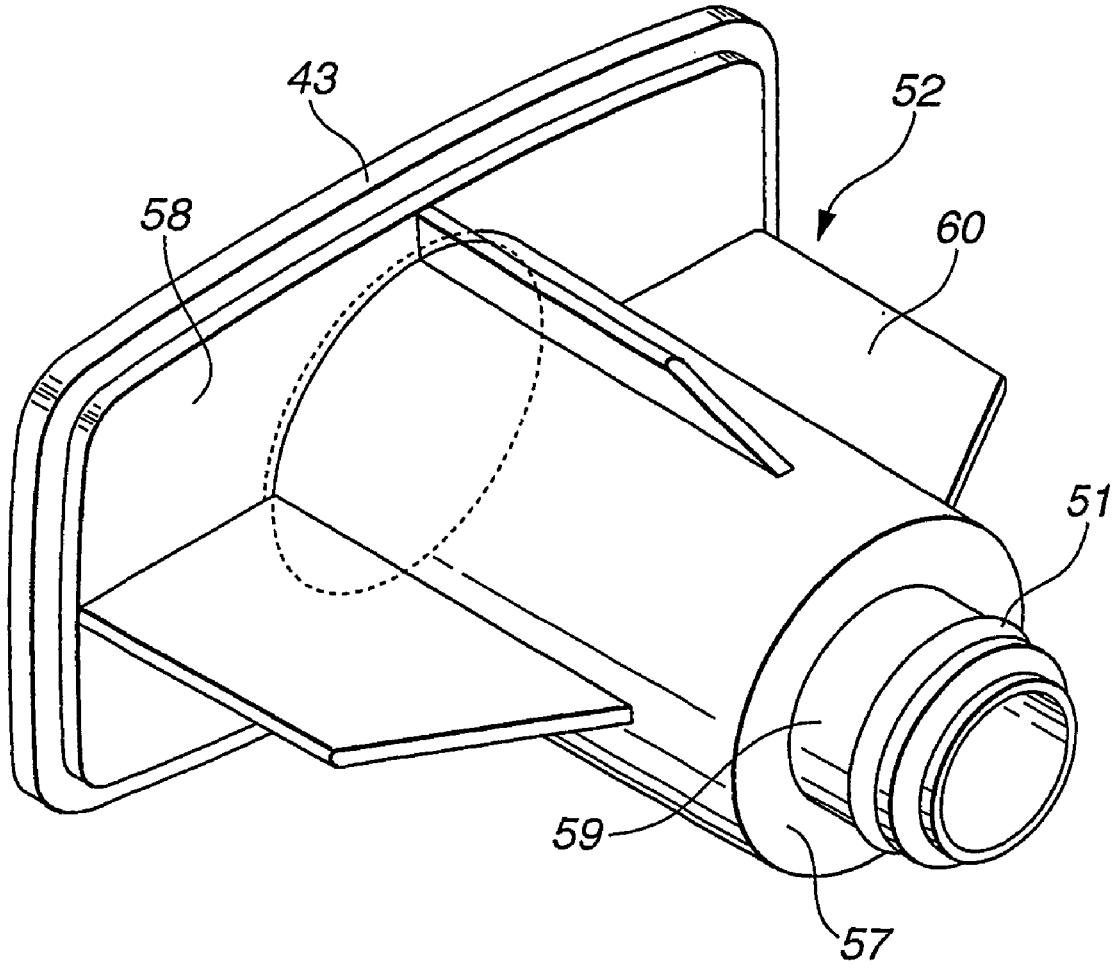
FIG. 5 is an enlarged perspective view of an adsorbing material cartridge of the fuel vapor treatment device of FIG. 4.

FIGS. 4 and 5 illustrate a second embodiment of the fuel vapor treatment device according to the present invention, which is similar to the first embodiment fuel vapor treatment device. In this embodiment, the adsorbing material cartridge 52 includes a cylindrical cartridge main body section 56 which defines therein a charging chamber in which the activated carbon 31 is filled. The charging chamber of the cartridge main body section 36 has a cross-sectional area smaller than that of the second charging chamber 25. The cartridge main body section 56 is integrally provided with first (right-side) or inner flange 57 and second (left-side) flange 58. The first flange 57 radially inwardly extends from first (right-side) end portion of the cartridge main body section 56. In other words, the first flange 57 is perpendicular to the axis of the adsorbing material cartridge 32. The second flange 58 radially outwardly extends from second (left-side) end portion of cartridge main body section 56. The cylindrical wall section 59 is formed integral with the inner flange section and axially extends from the first flange 57 of adsorbing material cartridge 52. The second casing section 20*a* of the casing 20 includes a cylindrical wall section 50 which is formed integral with the main body of second casing section 20*a* and is smaller in cross-sectional area than the main body of second casing section 20*a* so that a generally annular step portion (no numeral) is formed between the main body of second casing section and the cylindrical wall section 50. The first flange 57 of the adsorbing material cartridge 52 is in contact with the step portion, and the cylindrical wall section 59 of the cartridge 52 is inserted inside the cylindrical wall section 50. An annular sealing member or O-ring 51 is fitted in an annular groove (no numeral) formed at the peripheral surface of the cylindrical wall section 59 so that gas tight seal is established between the outer peripheral surface of cylindrical wall section 59 and the inner peripheral surface of cylindrical wall section 50. The cartridge main body section 56 is integrally provided with a plurality of ribs 60 which radially outwardly extend therefrom and axially extend to be integral with the second flange 58. The radially outward end edge of each rib 60 and the outer peripheral edge of the second flange 58 are shaped corresponding to the inner peripheral surface of the second casing section 20*a* defining the second charging chamber 25, and are slidably fitted to the inner peripheral surface of the second casing section 20*a*.

In this embodiment, a cap section (no numeral) formed with the atmospheric air port 53 is fixedly mounted on the second casing section 20*a* of the casing 20 in such a manner that its annular bottom portion is fixed to the annular step portion of the second casing section 20*a*. The atmospheric air port 53 is formed inside a pipe portion (no numeral) which is perpendicular to the axis of the adsorbing material cartridge 52 thereby forming a generally L-shaped air flow passage upstream of the adsorbing material cartridge 52.

While the sealing member 41, 51 disposed between the cylindrical wall section of the adsorbing material cartridge 52 and the cylindrical wall section of the second casing section 20*a* of the casing 20 has been shown and described as having the generally U-shaped cross-section or of the form of O-ring in the first and second embodiments, it will be understood that the seal member may have a generally V-shaped cross-section or a generally D-shaped cross-section.

Figure 6:
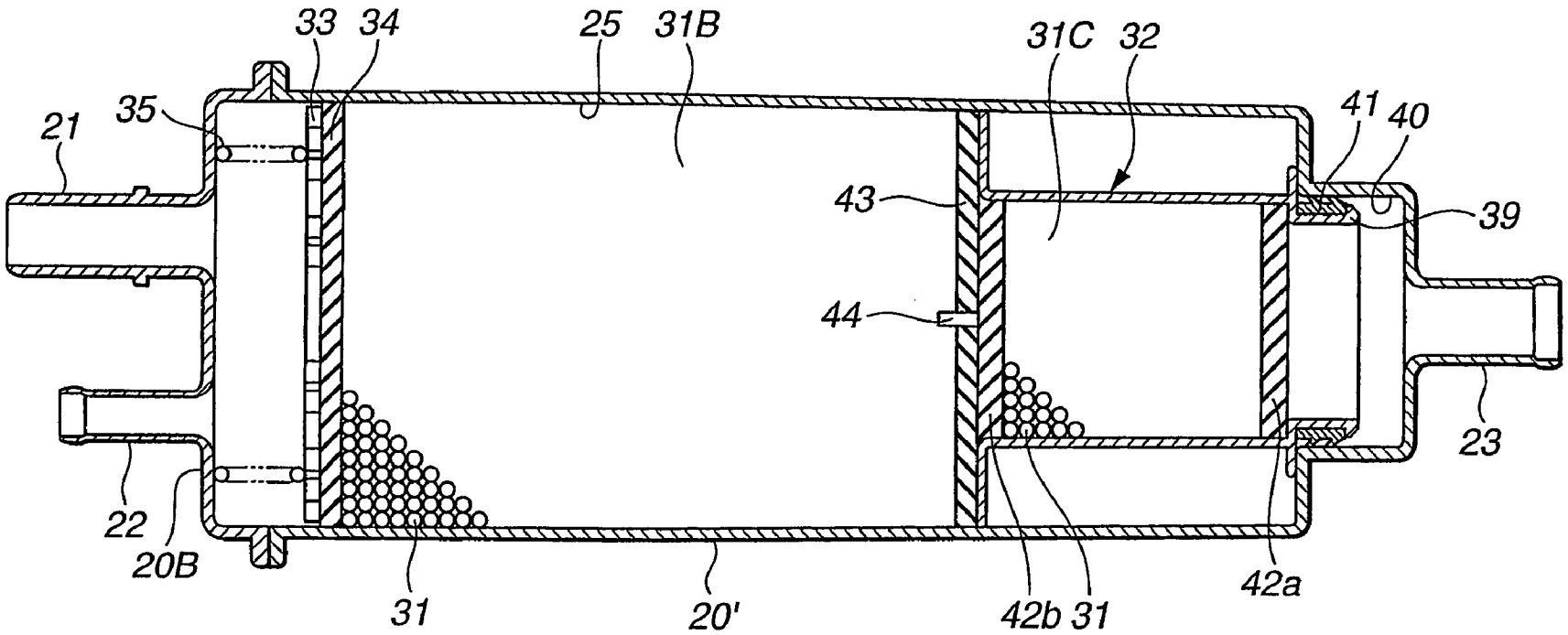
FIG. 6 is a vertical sectional view of a third embodiment of the fuel vapor treatment device according to the present invention.

FIG. 6 illustrates a third embodiment of the fuel vapor treatment device according to the present invention, which is similar to the first embodiment fuel vapor treatment device shown in FIGS. 1 to 3 with the exception that the first casing section (defining the first charging chamber 24) of the casing 20' is omitted in which the charge port 21 and the purge port 22 are formed at the second (left-side) end section of the second casing section (defining the second charging chamber 25). More specifically, the charge port 21 and the purge port 22 are formed in a bottom wall 20B of the casing 20. The spring 35 is disposed between the bottom wall 20B and the porous plate 33. Thus, the fuel vapor treatment device of this embodiment has two activated carbon layers without the first activated carbon layer 31A. While the adsorbing material cartridge 32 has been described as having been previously produced to be assembled in the casing 20' in the above embodiments, it will be understood that the adsorbing material cartridge 32 may not have been previously produced, in which the cartridge main body section 36 provided with the sealing member 41 such as the packing material or the O-ring is disposed inside the cylindrical wall section 40 of the casing 20, followed by supplying other component parts and the activated carbon 31 to the casing 20'.

Figure 7:
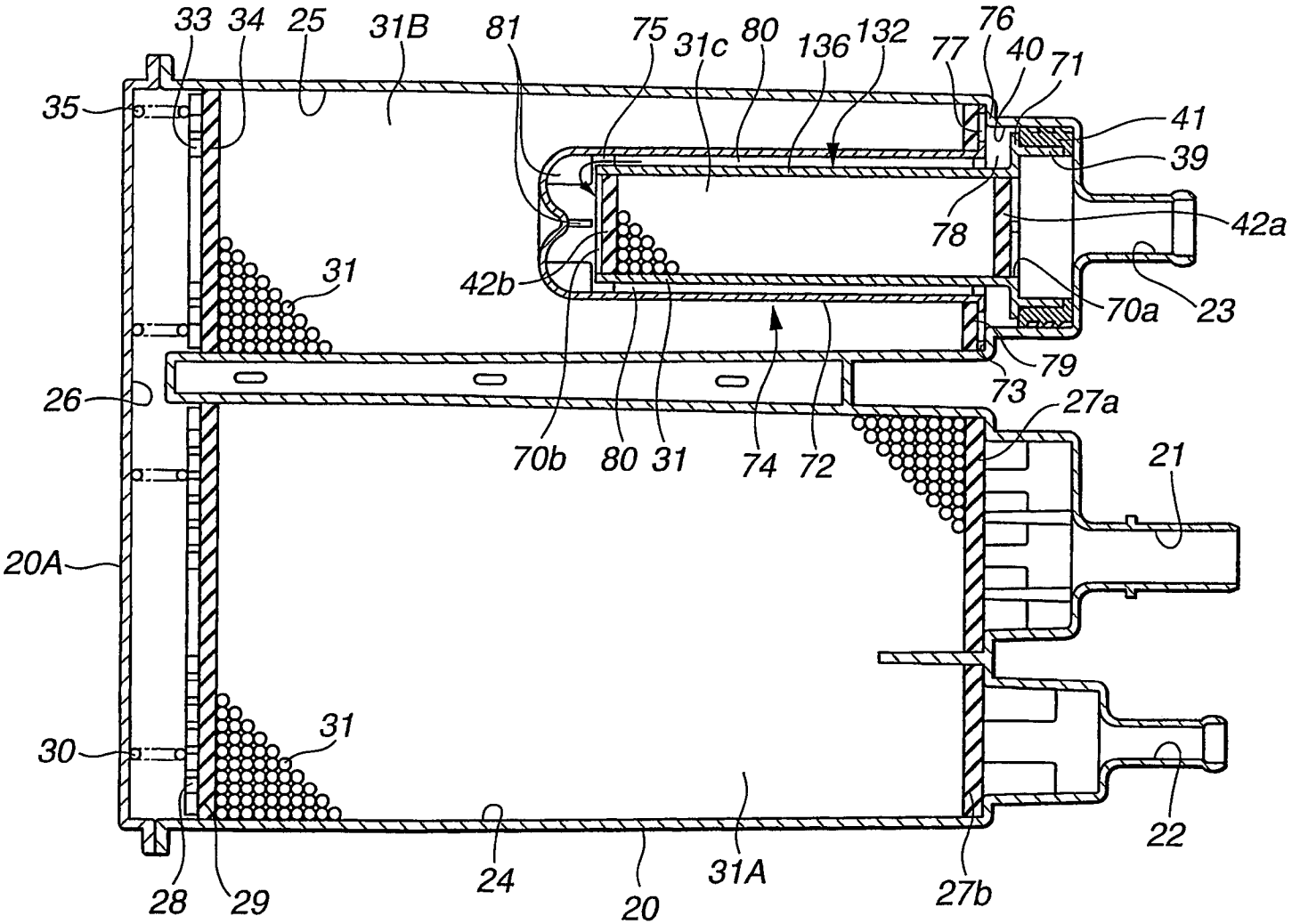
FIG. 7 is a vertical sectional view of a fourth embodiment of the fuel vapor treatment device according to the present invention.

FIG. 7 illustrates a fourth embodiment of the fuel vapor treatment device according to the present invention, which is similar to the first embodiment fuel vapor treatment device except for the shape of the adsorbing material cartridge 132 and an arrangement around the cartridge 132. In this embodiment, the adsorbing material cartridge 132 includes a cylindrical cartridge main body section 136 which defines therein a charging chamber in which the activated carbon 31 is filled, thereby forming the third activated carbon layer 31C. The charging chamber of the cartridge main body section 136 has a cross-sectional area smaller than that of the second charging chamber 25. The third activated carbon layer 31C has the L/D value of about 1.5 (not less than 1.0) as same as that in the first embodiment fuel vapor treatment device. The cartridge main body section 136 is integrally provided with a flange 71 which radially outwardly extends from the first (right-side) end portion of the cartridge main body section 136. In other words, the flange 71 is perpendicular to the axis of the adsorbing material cartridge 132. The cylindrical wall section 39 is formed integral with and axially extends from the flange 71. The second casing section of the casing 20 includes the cylindrical wall section 40 which is formed integral with the main body of the second casing section and is smaller in cross-sectional area than the main body of second casing section so that a generally annular step portion 76 is formed between the main body of the second casing section and the cylindrical wall section 40. The flange 71 and the cylindrical wall section 39 of the cartridge 132 are inserted inside the cylindrical wall section 40. The generally annular sealing member or packing material 41 is disposed around the outer peripheral surface of cylindrical wall section 39 so that gas tight seal is established between the outer peripheral surface of cylindrical wall section 39 and the inner peripheral surface of the cylindrical wall section 40. A gas flow opening 70*a* is formed at the first (right-side) end section of the cartridge main body section 136 and communicated with the atmospheric air port 23 through a space defined inside the cylindrical wall section 39.

A cap-shaped air guide member 74 is disposed covering the major part of the cartridge main body section 136. The air guide member 74 includes an air guide member main body section 72 which has an inner diameter slightly larger than the outer diameter of the cartridge main body section 136 and closed at the bottom or second (left-side) end section. The air guide member 74 is integrally provided with a flange 73 which radially outwardly extends from the first (right-side) end section of the air guide member 74, defining an opening in which the cartridge main body section 136 is located. This air guide member 74 covers the major part of the cartridge main body section 136, maintaining a certain annular space between the inner peripheral surface of the air guide member 74 and the outer peripheral surface of the major part of the cartridge main body section 136.

The air guide member 74 is in a state where the flange 73 is in contact with and supported to the annular step portion 76 integrally connected to the cylindrical wall section 40, in which an annular space between the inner wall surface of the second casing section of the casing 20 and the outer wall surface of the air guide member main body section 72. This annular space is filled with the activated carbon 31, and therefore a part of the second activated carbon layer 31B is formed in the annular space. The flange 73 is formed with an air flow opening 77 through which the second activated carbon layer 31B is communicated with an annular space 78 formed between the flange 71 of the adsorbing material cartridge 132 and the flange 73 of the air guide member 74. An annular filter 79 is welded and fixed to the flange 73 at a surface facing the second activated carbon layer 31B in order to dam up the activated carbon 31. The annular space 78 is communicated with the annular space formed between the inner peripheral surface of the air guide member 74 and the outer peripheral surface of the major part of the cartridge main body section 136. Thus, a bent gas flow passage 75 is formed between the air guide member 74 and the adsorbing material cartridge 132 in such a manner to meanderingly reach a gas flow opening 70*b* formed at the second (left-side) end portion of the cartridge main body section 136.

A plurality of ribs 80 are axially formed at the inner peripheral surface of the air guide member main body section 72. Additionally, a plurality of ribs 81 are formed at the inner surface of the bottom end section and radially arranged. These ribs 80, 81 are formed in directions not to hamper flow of fuel vapor. These ribs 80, 81 can reinforce the air guide member 74 and suppress a play produced between the adsorbing material cartridge 142 and the air guide member 74. Additionally, the ribs 80, 81 function as insertion guides when the air guide member 74 is inserted in the second charging chamber 25 and installed around the adsorbing material cartridge 132.

In this embodiment, the L/D value of the third activated carbon layer 31C in the adsorbing material cartridge 132 is set at about 1.5, and therefore the L/D value of the whole fuel vapor treatment device becomes larger than the L/D of the third activated carbon layer 31C. As a result, HC gas emission to atmospheric air can be sufficiently suppressed similarly to in the first embodiment fuel vapor treatment device. Additionally, in the fuel vapor treatment device of this embodiment, HC gas flows from the second activated carbon layer 31B to the third activated carbon layer 31C through the bent gas flow passage 75 which is formed between the air guide member 74 and the adsorbing material cartridge 132, so that HC gas flows in a zigzag line changing its advancing direction. This sufficiently retards diffusion of HC gas into the third activated carbon layer 31C thereby further securely suppressing emission of HC gas through the atmospheric air port 23 into atmospheric air.

Further in the fuel vapor treatment device of this embodiment, the air guide member 74 covering the major part (including the cylindrical outer peripheral surface and the tip end surface) of the adsorbing material cartridge 132 is installed in the second casing section of the casing 20, so that a part of the second activated carbon layer 31B is formed around the air guide member 74 and in the second charging chamber 25. Accordingly, the adsorbing material cartridge 132 can be effectively disposed inside the casing 20 without forming a dead space in the second charging chamber 25. In other words, in this fuel vapor treatment device, the air guide member 74 is disposed to cover the adsorbing material cartridge 132 having a cross-sectional area smaller than that of the second charging chamber 25 having a certain cross-sectional area, in which the activated carbon 31 (or mixture particles of the activated carbon 31 and the heat-accumulative material) is filled in a region around the air guide member 74. As a result, useless space which does not contribute to adsorption of HC gas and to retardation of diffusion of HC gas is not formed within the second charging chamber 25, so that the almost whole space in the casing 20 can be effectively used.

Furthermore, in this embodiment of the fuel vapor treatment device, the air guide member 74 is provided with the flange 73 formed with the air flow openings 77, and the flange 73 is brought into contact with the step portion 76 in such a manner that the second charging chamber 25 is communicated through the openings 77 to the space 78. Accordingly, only by bringing the flange 73 into contact with the step portion 76, the passage communicating with the bend gas flow passage 75 can be readily formed.

Moreover, in this fuel vapor treatment device, the ribs 80 are formed at the inner peripheral surface of the air guide member main body section 72 and extend axially in the air guide member main body section 72. These ribs 80 reinforce the air guide member 74 itself and restrict a radial play of the air guide member 74 and the adsorbing material cartridge 132. Additionally, when the air guide member 74 is assembled in the casing 20, the ribs 81 serve as guides for the air guide member 74 so that the air guide member 74 can be readily installed around the outer peripheral surface of the adsorbing material cartridge 132. Further, the radially extending ribs 81 are formed at the inner surface of the generally cup-shaped end wall of the air guide member 74. These ribs 81 also can reinforce the air guide member 74 and restrict a radial play of the adsorbing material cartridge 132.

The fuel vapor treatment device of this embodiment is assembled as follows: The adsorbing material cartridge 132 has been previously produced containing therein the activated carbon 31, and is brought into fit to the inner wall of the cylindrical wall section 40. Subsequently, the air guide member 74 and the filter 79 are installed in position in the second charging chamber 25. Then, the filters 27*a*, 27*b* are installed in position in the first charging chamber 24. Thereafter, the activated carbon 31 is filled in the remaining spaces in the first and second charging chambers 24, 25. Then, the filters 29, 34, the porous plates 28, 33 and the springs 30, 35 are disposed in respective positions as shown in FIG. 7. Thereafter, the cover 20A is installed to close the second end sections of the first and second charging chambers 24, 25, maintaining the communication passage 26, followed by welding the peripheral portion of the cover 20A to the casing 20.

Also in this embodiment, by suitably setting the adsorbing material cartridge 132 and the air guide member 74, it can be accomplished to provide the fuel vapor treatment device well corresponding to the displacement of the engine, the size of the fuel tank, or the like. Furthermore, while the air guide member 74 has been described as being installed around the adsorbing material cartridge 132 after the adsorbing material cartridge 132 is assembled in the casing 20 so that the air guide member 74 is pressed by the second activated carbon layer 31B in this embodiment, it will be understood that the air guide member 74 may be formed integral with the casing 20, in which an outlet member (not shown) integrally provided with the cylindrical wall section 40 and formed with the atmospheric air port 23 is separately formed, and then the outlet member to which the adsorbing material cartridge 132 is attached is welded to the casing 20.

Figure 8:
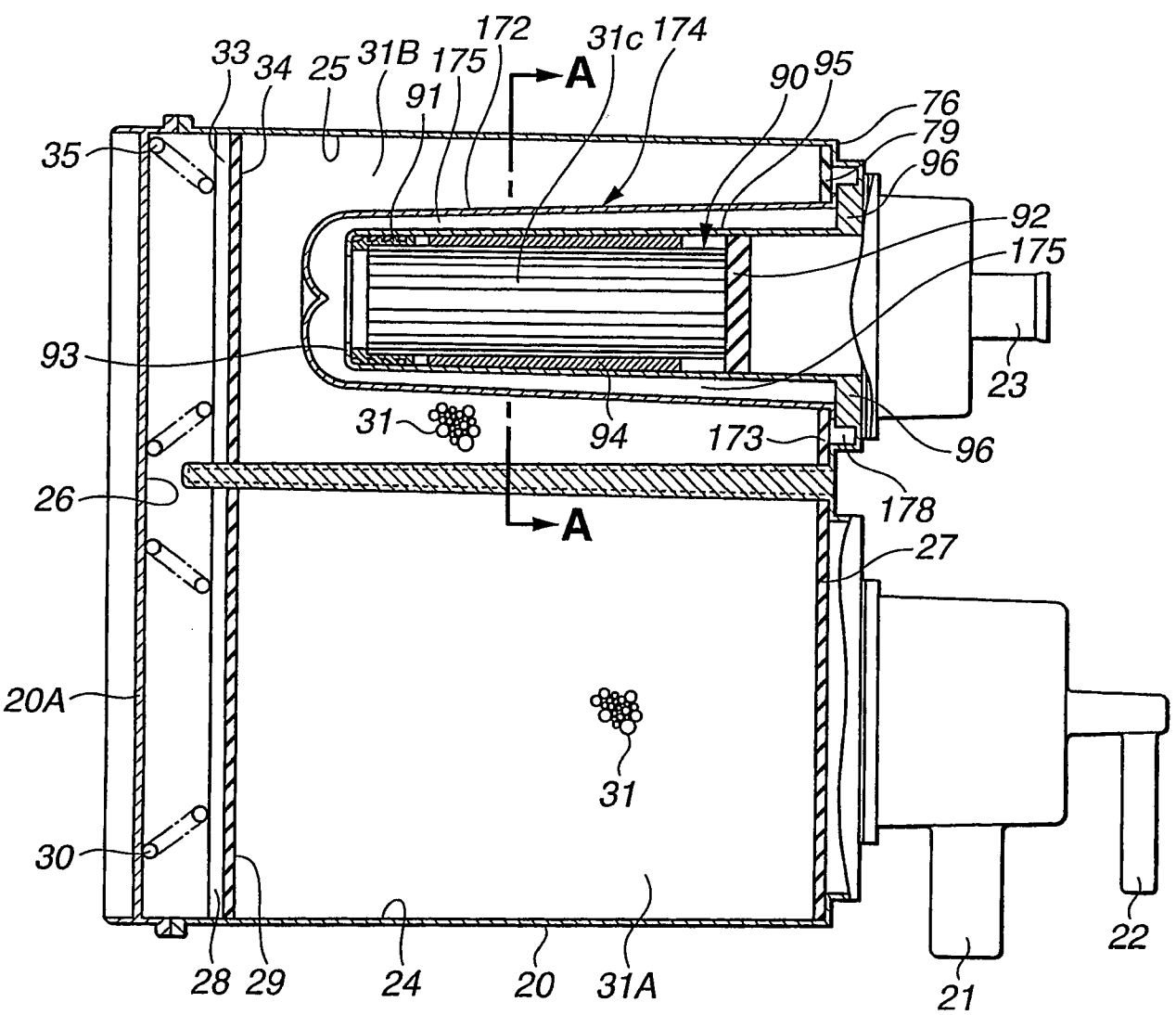
FIG. 8 is a vertical sectional view of a fifth embodiment of the fuel vapor treatment device according to the present invention.
Figure 9:
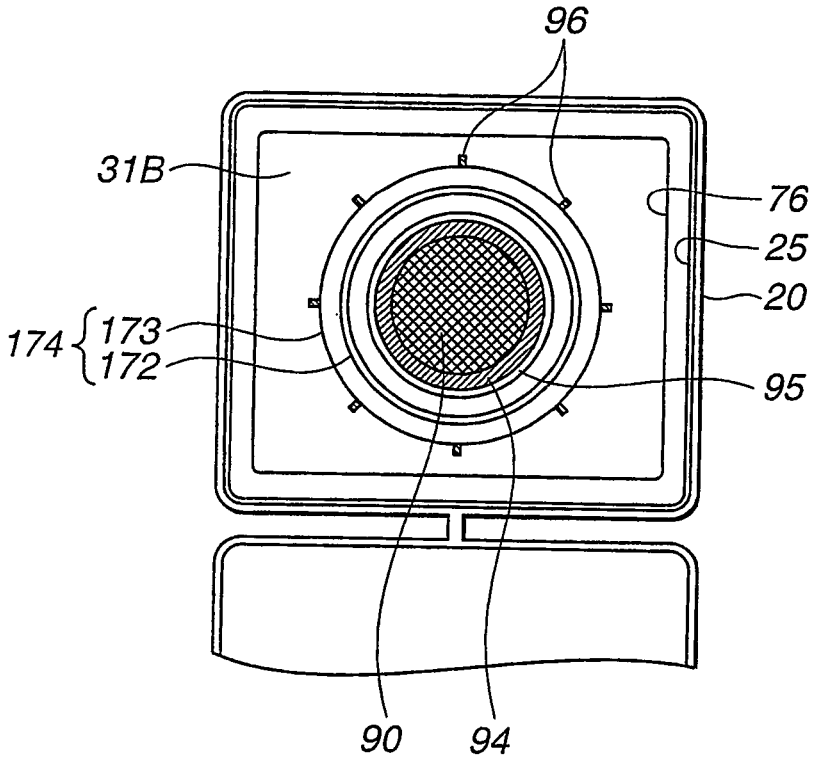
FIG. 9 is a fragmentary sectional view taken in the direction of arrows substantially along the line A—A of FIG. 8.
Figure 10:
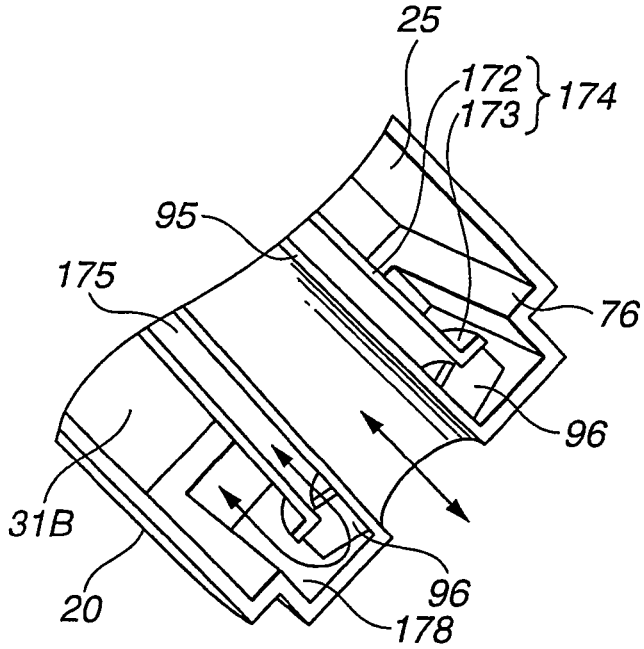
FIG. 10 is a fragmentary perspective view, in section, of an essential part of the fuel vapor treatment device of FIG. 8.

While the granulated fuel vapor adsorbing material (activated carbon) has been shown and described as being used in the adsorbing material cartridge in this embodiment, the granulated fuel vapor adsorbing material may be replaced with a fuel vapor adsorbing material having a honeycomb structure as will be shown in FIGS. 8 to 10, in which a spacer of non-woven fabric or the like is disposed on the outer peripheral surface of the adsorbing material having the honeycomb structure thereby preventing a play from being produced between the inner peripheral surface of the cartridge main body section 136 and the outer peripheral surface of the adsorbing material.

FIGS. 8 to 10 illustrate a fifth embodiment of the fuel vapor treatment device according to the present invention, which is similar to the fourth embodiment fuel vapor treatment device of FIG. 7 mainly except for the structure within the second charging chamber 25, particularly the structure of a section including the third activated carbon layer 31C. In this embodiment, the first end section formed with the charge and purge ports 21, 22 of the first casing section of the casing 20 is provided with a common filter 27 for maintaining the activated carbon 31.

The arrangement of the fifth embodiment will be discussed concerning a section different from the fourth embodiment and its periphery. In this embodiment, the third activated carbon layer 31C is formed of a monolithic adsorbing material formed body 90 containing activated carbon as a main component. The adsorbing material formed body 90 has a so-called honeycomb structure which has a plurality of fine gas flow passages which axially extend. The adsorbing material formed body 90 has a cross-sectional area (perpendicular to the axis of each gas flow passage of the adsorbing material formed body) smaller than a cross-sectional area (perpendicular to the axis) of the second charging chamber 25. The L/D value of the whole adsorbing material formed body 90 is set at about 1.5 (not less than 1). The adsorbing material formed body 90 is produced by forming powder-like activated carbon into a certain form using a binder which is preferably higher in heat conductivity and specific heat than activated carbon. Using such binder together with activated carbon will provide the same effects as those obtained in case that the mixture of activated carbon and the heat-accumulative material is filled as the third activated carbon layer 31C as discussed in the description of the first embodiment fuel vapor treatment device.

Additionally, the wall of the first end section (formed with the atmospheric air port 23) of the second casing section of the casing 20 is integrally provided with a cylindrical wall section 95 which extends toward the second end section of the second casing section. The adsorbing material formed body 90 is disposed inside the cylindrical wall section 95, together with a sealing member 91 and a filter 92. The sealing member 91 is disposed between the outer peripheral surface of the adsorbing material formed body 90 and the inner peripheral surface of the cylindrical wall section 95 so as to provide a gas tight seal therebetween. The filter 92 is fitted to the inner peripheral surface of the cylindrical wall section 95 so as to prevent the adsorbing material formed body 90 from getting out of its position. The tip end section of the cylindrical wall section 95 is provided with a rib 93 which prevents the sealing member 91 and the adsorbing material formed body 90 from getting out of the cylindrical wall section 95 through the tip end section of the cylindrical wall section 95. The reference numeral 94 denotes a non-woven fabric interposed between the outer peripheral surface of the adsorbing material formed body 90 and the cylindrical wall section 95 thereby to prevent a play from being produced between the adsorbing material formed body 90 and the cylindrical wall section 95. The adsorbing material formed body 90, the seal member 91, the filter 92 and the non-woven fabric 94 constitute the adsorbing material cartridge. In other words, the adsorbing material formed body 90 constitutes the cartridge main body section or major part of the adsorbing material cartridge. It will be understood that granulated activated carbon may be directly supplied or supplied upon being packed in another container, inside the cylindrical wall section 95 in place of the adsorbing material cartridge.

As clearly shown in FIG. 10, a plurality of ribs 96 are formed integral with the base section of the cylindrical wall section 95 and the inner surface of the first end section (formed with the atmospheric air port 23) of the second casing section of the casing 20. These ribs 96 radially outward extend from the base section of the cylindrical wall section 95. The cylindrical air guide member 174 for covering the major part of the cylindrical wall section 95 is brought into fit to and supported by the upper end edges of the ribs 96. Specifically, the air guide member 174 includes a generally cylindrical air guide member main body section 172 which has an inner peripheral diameter slightly larger than the inner peripheral diameter of the cylindrical wall section 95 and closed at its tip end. A radially outwardly extending annular flange 173 is integrally formed at its base end (having an opening) of the air guide member main body section 172. This flange 173 is brought into contact with the upper end edges of the ribs 96.

The air guide member 174 in a state of being installed within the second casing section of the casing 20 defines the second activated carbon layer 31B within the second charging chamber 25 and defines a bent gas flow passage 175 between it and the cylindrical wall section 95 which passage 175 extends from the outside of the air guide member 174 into an gas flow passage formed between it and the cylindrical wall section 95. Additionally, the second end section of the second casing section of the casing 20 is decreased in diameter so as to form the annular step portion 76. A filter 79 is disposed to be brought into contact with the step portion 76 and the flange 173 of the air guide member 174 so as to maintain the activated carbon 31 of the second activated carbon layer 31B. The flange 173 is formed to have an outer diameter slightly smaller than the inner diameter of the step portion 76 thereby forming an annular clearance passage through which gas flows so that gas can flow between the outside and inside of the air guide member 172. The ribs 96 formed integral with the casing 20 form a space 178 between the flange 173 of the air guide member 174 and the end wall of the second casing section of the casing 20, so that the second activated carbon layer 31B is communicated through this space 178 with the bent gas flow passage 175.

With the thus arranged fuel vapor treatment device of the fifth embodiment, HC gas reaching the second activated carbon layer 31B during stop of the engine and the like flows meandering through the space 178 located around the base section of the air guide member 174 and through the bent gas flow passage 175 so as to reach the tip end side of the cylindrical wall section 95. Then, HC gas flows into the adsorbing material formed body 90 through the tip end of the cylindrical wall section 95 so as to be adsorbed into the adsorbing material formed body 90.

In this embodiment, the adsorbing material formed body 90 has the cross-sectional area smaller than the cross-sectional area of the second charging chamber 25, and the L/D value of the adsorbing material formed body 90 is set at about 1.5 (not less than 1) so that the L/D value of the whole fuel vapor treatment device becomes larger than about 1.5. Additionally, the second activated carbon layer 31B and the adsorbing material formed body 90 are communicated with each other through the bent gas flow passage 175 formed between the cylindrical wall section 95 and the air guide member 174, and therefore HC gas flowing from the second activated carbon layer 31B to the third activated carbon layer 31C (or the adsorbing material formed body 90) is subjected to effects under the bent gas flow passage 175. Accordingly, in this embodiment, emission of HC gas through the atmospheric air port 23 can be securely suppressed under the effect of a large L/D value of the whole fuel vapor treatment device and under the diffusion retardation effect due to the meandering flow of HC gas through the bent gas flow passage 175.

In this embodiment, the cylindrical wall section 95 is formed integral with the casing 20 in which a section formed with the atmospheric air port 23 is welded to the casing 20 at a position above the cylindrical wall section 95, and therefore the L/D value of the whole fuel vapor treatment device can be readily changed merely by replacing the adsorbing material formed body (or adsorbing material cartridge) 90 having different axial lengths or cross-sectional areas, to be installed inside the cylindrical wall section 95, without re-designing the whole body of the casing 20.

Additionally, in this embodiment, the air guide member 174 covering the major part (including the cylindrical outer peripheral surface and the tip end surface) of the cylindrical wall section 95 is installed in the second casing section of the casing 20, so that a part of the second activated carbon layer 31B is formed around the air guide member 174 and in the second charging chamber 25. Accordingly, the adsorbing material formed body 90 can be effectively disposed inside the casing 20 without forming a dead space in the second charging chamber 25. This makes the whole fuel vapor treatment device more compact.

Figure 11:
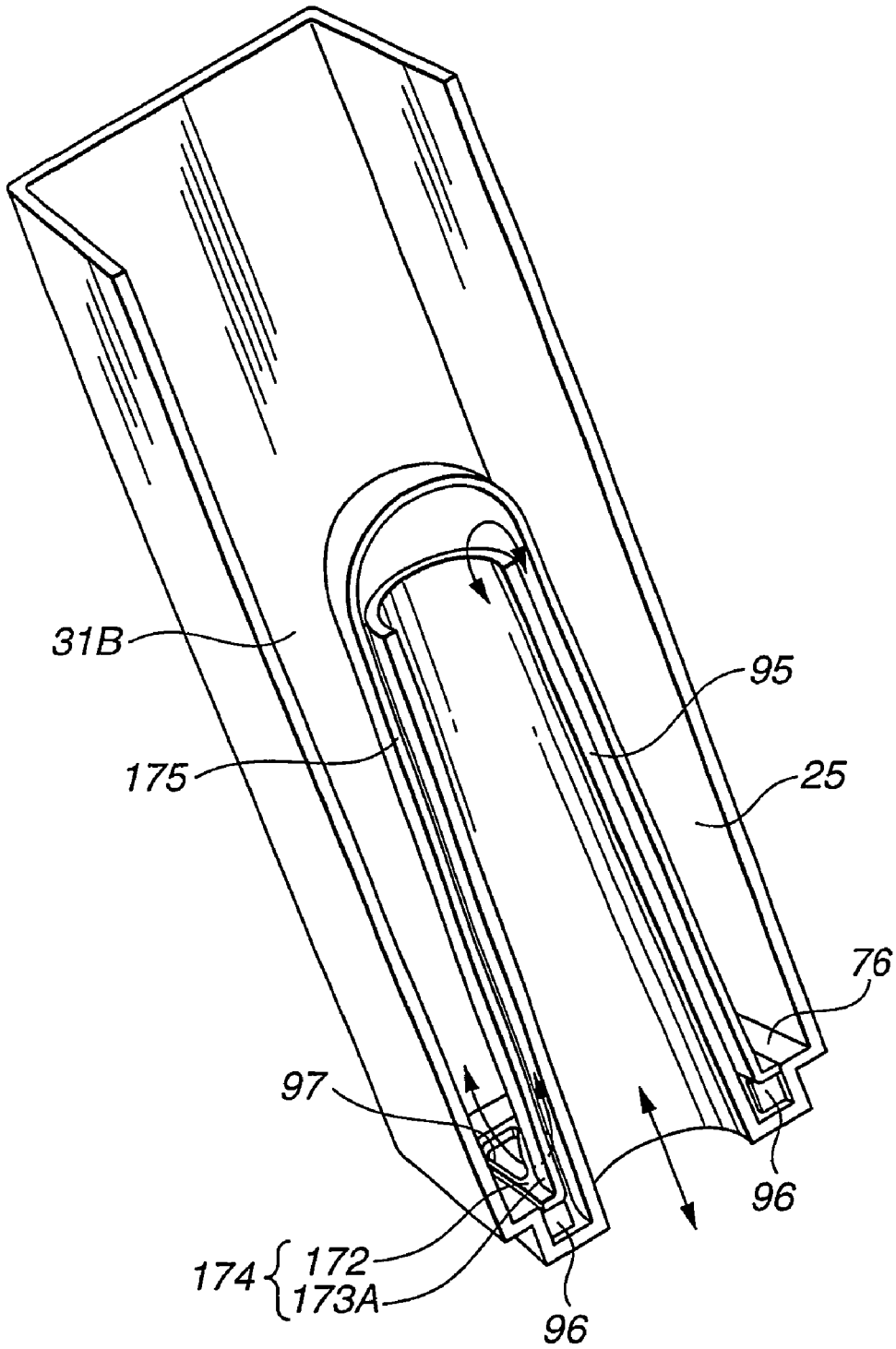
FIG. 11 is a fragmentary perspective view, in section, of an essential part of a sixth embodiment of the fuel vapor treatment device according to the present invention.

FIG. 11 illustrates a sixth embodiment of the fuel vapor treatment device according to the present invention, similar to the fifth embodiment fuel vapor treatment device of FIGS. 8 to 10 except for a structure around the flange 173A of the air guide member 174. In this embodiment, the flange 173A of the air guide member 174 is formed to be brought into fit with the annular step portion 76, in which the flange 137 is formed with a gas flow opening 97. In this regard, in the fifth embodiment, the annular clearance has been shown and described as being formed between the inner periphery of the annular step portion 76 of the casing 20 and the flange 173 of the air guide member 174 so as to serve as the gas flow passage. In this embodiment, only by bringing the flange 173A of the air guide member 174 into contact with the annular step portion 76 of the casing 20, the activated carbon filled outside the air guide member 174 is communicated with the bent gas flow passage 175 through the air flow opening 97, and therefore it becomes easy to form the air flow passage connecting to the bent gas flow passage 175.

Figure 12:
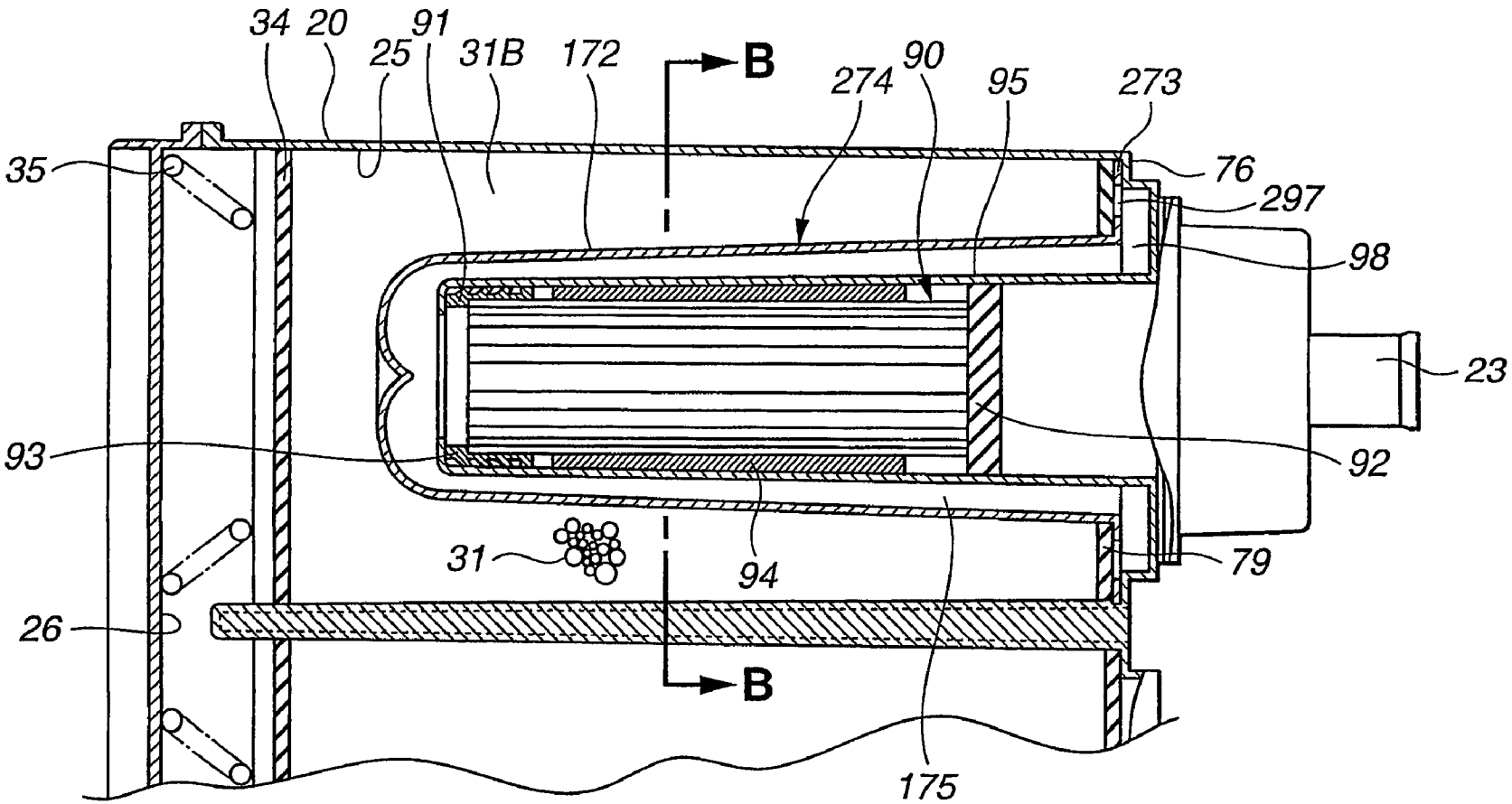
FIG. 12 is a fragmentary vertical sectional view of an essential part of a seventh embodiment of the fuel vapor treatment device according to the present invention.
Figure 13:
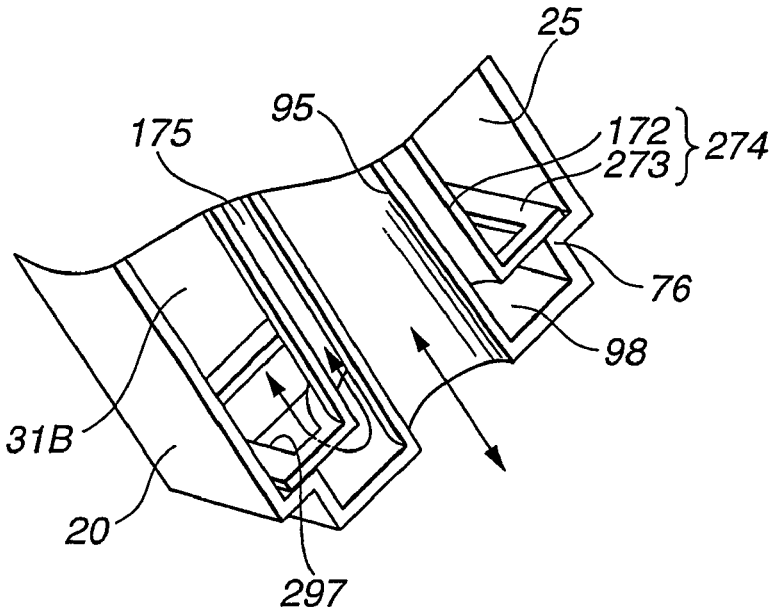
FIG. 13 is a fragmentary perspective view, in section, of an essential part of the fuel vapor treatment device of FIG. 12.
Figure 14:
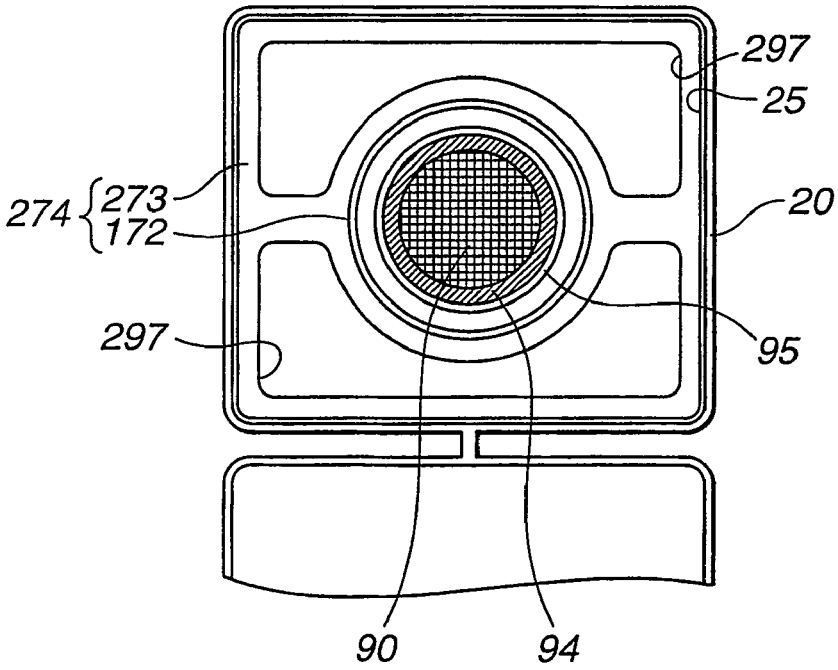
FIG. 14 is a fragmentary sectional view taken in the direction of arrows substantially along the line B—B of FIG. 12.

FIGS. 12 to 14 illustrate a seventh embodiment of the fuel vapor treatment device according to the present invention, which is basically similar to the fifth and sixth embodiments with exception that the outer peripheral portion of the flange 273 of the air guide member 274 is in contact with and supported by the inner surface of the annular step portion 76. More specifically, the flange 273 has an outer peripheral edge whose profile corresponds to the inner peripheral shape of the second casing section defining therein the second charging chamber 25. The flange 273 is formed with two gas flow openings 297 whose outer periphery generally corresponds to the shape of the inner periphery of the step portion 76. By bringing this flange 273 into contact with and being supported by the surface of the step portion 76, a space 98 for allowing communication between the gas flow openings 297 and the bent gas flow passage 175 is formed between the flange 273 and the end wall of the second casing section of the casing 20.

It will be appreciated that this embodiment can provide the basically same effects as those in the fifth and sixth embodiments, and can further provide an advantageous effect that the passage (space 98) for connecting the second activated carbon layer 31B and the bent gas flow passage 175 can be readily formed without forming ribs on the side of the casing 20.

Figure 15:
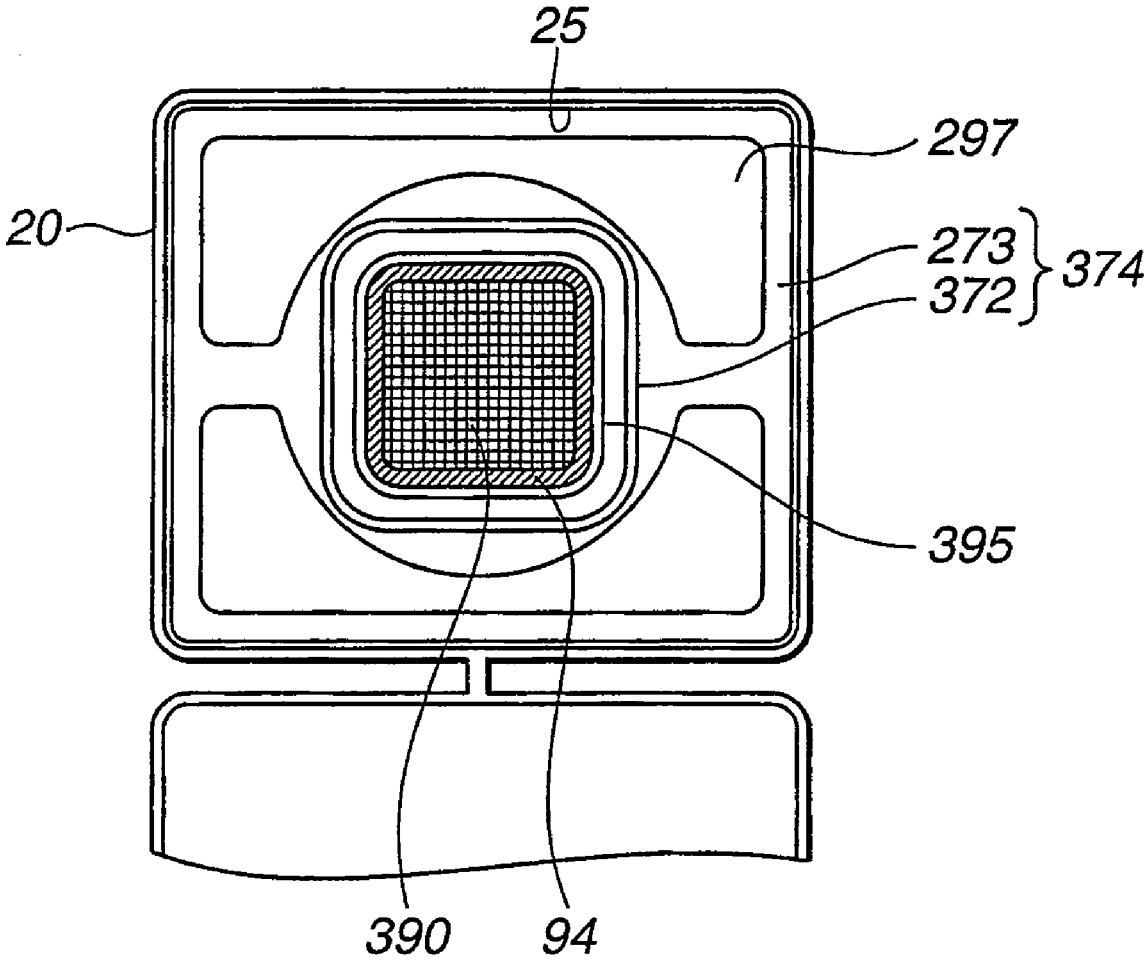
FIG. 15 is a fragmentary sectional view similar to FIG. 14 but showing an eighth embodiment of the fuel vapor treatment device according to the present invention.

FIG. 15 illustrates an eighth embodiment of the fuel vapor treatment device, similar to the seventh embodiment fuel vapor treatment device of FIGS. 12 to 14 with the exception that the adsorbing material formed body 390 is formed having a generally square or rectangular cross-sectional shape. In this embodiment, the cylindrical wall section 395 and the air guide member main body section 372 of the air guide member 374 are formed having a generally square or rectangular cross-sectional shape corresponding to the cross-sectional shape of the adsorbing material formed body 90. In this regard, in the seventh embodiment fuel vapor treatment device, the adsorbing material formed body 90 is formed cylindrical.

Figure 16:
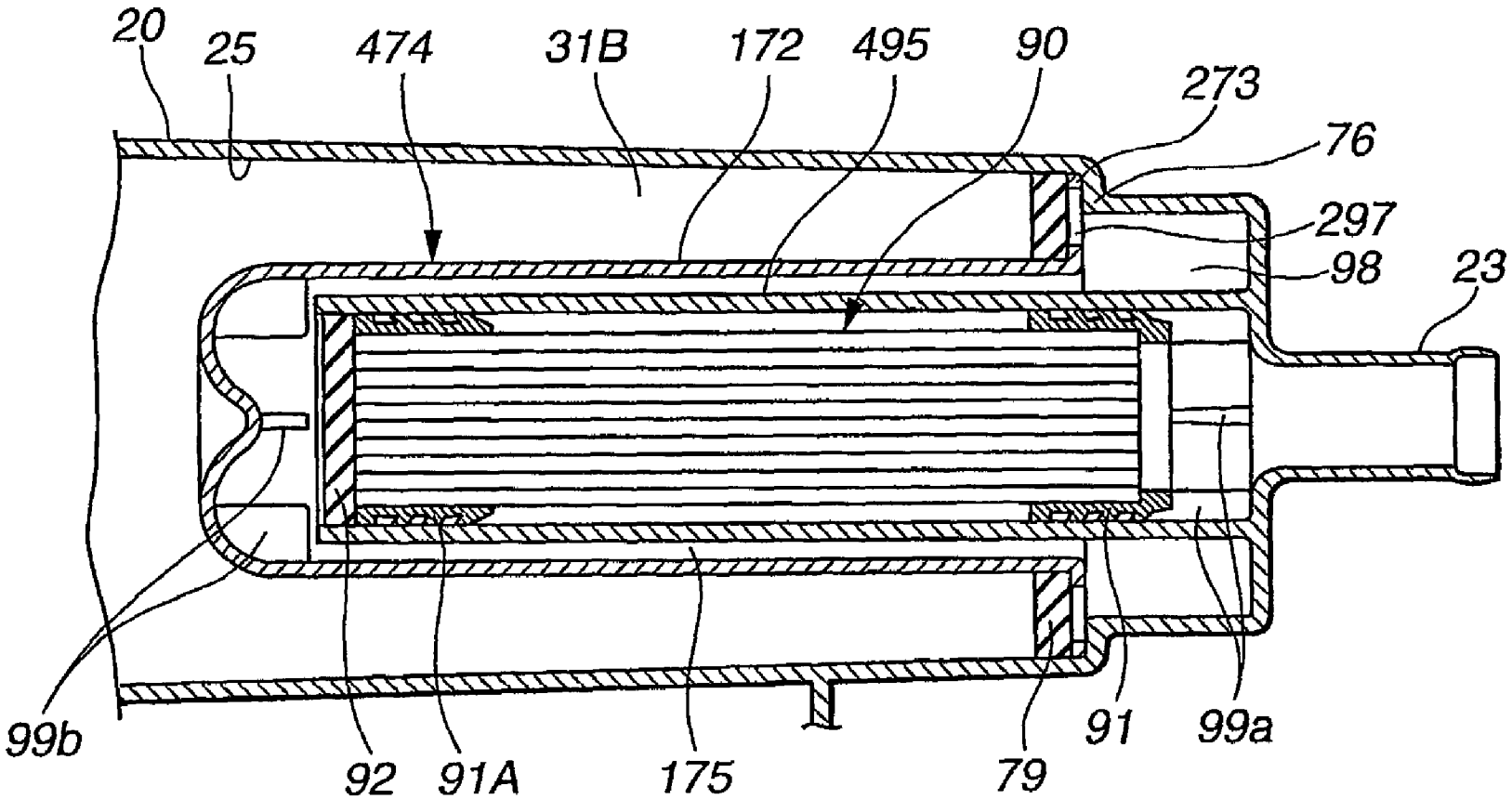
FIG. 16 is a fragmentary vertical sectional view of an essential part of a ninth embodiment of the fuel vapor treatment device according to the present invention.

FIG. 16 illustrates a ninth embodiment of the fuel vapor treatment device, similar to the seventh embodiment fuel vapor treatment device of FIGS. 12 to 14 with the exception that a section formed with the atmospheric air port 23 is formed integral with the casing 20, and no rib is formed at the tip end portion of the cylindrical wall section 495 so that the adsorbing material cartridge including the adsorbing material formed body 90 is inserted through the tip end portion (having an opening) of the cylindrical wall section 495. In this case, ribs 99*a* and ribs 99*b* are formed respectively at the inner surface of the cylindrical wall section 495 at a position adjacent the atmospheric air port 23 and at the bottom inner surface of the air guide member 474 thereby preventing the adsorbing material formed body 90 from getting out of the cylindrical wall section 495 and from forming its play. Also in this case, granulated activated carbon may be directly supplied or supplied upon being packed in another container, inside the cylindrical wall section 95 in place of the adsorbing material cartridge. The adsorbing material formed body 90 is provided at its opposite end portions with the sealing members (or packing materials) 91, 91A, and disposed inside the cylindrical wall section 495 of the second casing section of the casing 20. Each sealing member 91, 91A is interposed between the outer peripheral surface of the adsorbing material formed body 90 and the inner peripheral surface of the cylindrical wall section 495 so as to establish a gas tight seal between the adsorbing material formed body 90 and the cylindrical wall section 495. In this regard, in the seventh embodiment, the tip end section of the cylindrical wall section 95 is provided the rib 93 which prevents the sealing member 91 and the adsorbing material formed body 90 from getting out of the cylindrical wall section 95 through the tip end section of the cylindrical wall section 95, so that the adsorbing material formed body 90 is inserted into the cylindrical wall section 95 through the opening at the base section of the cylindrical wall section 95.

Figure 17:
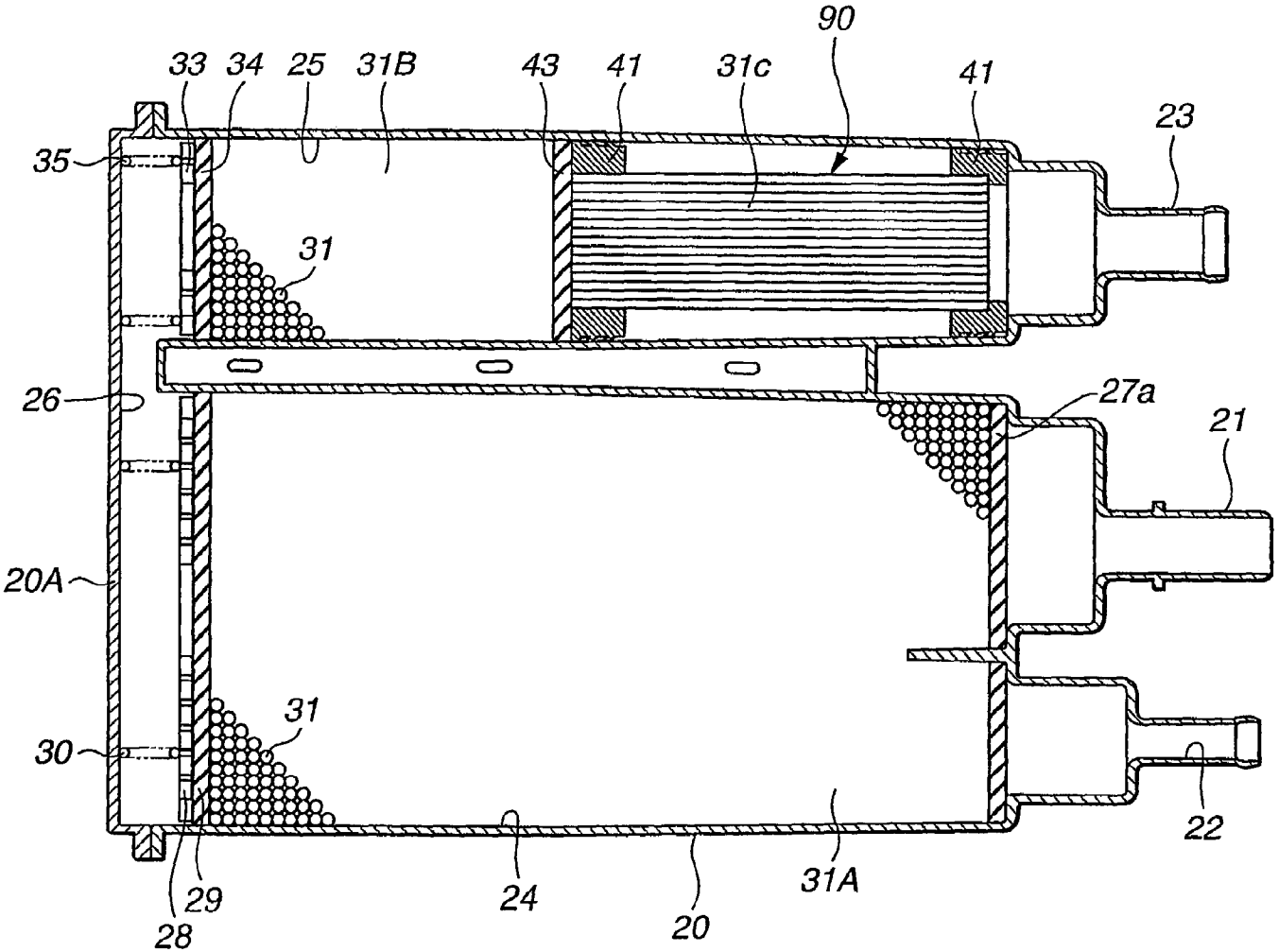
FIG. 17 is a vertical sectional view of a tenth embodiment of the fuel vapor treatment device according to the present invention.
Figure 18:
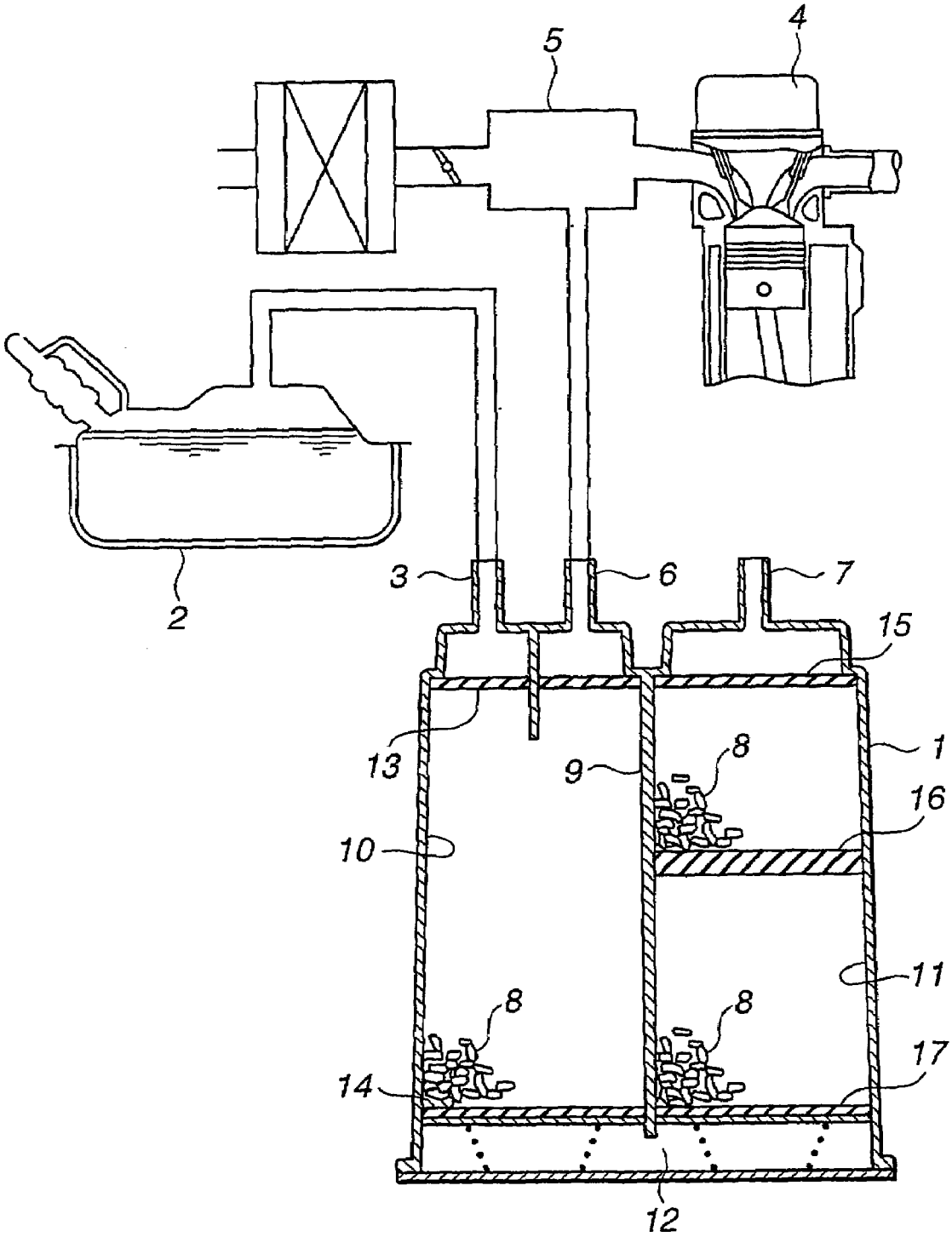
FIG.18 PRIOR ART
FIG. 18 is a vertical sectional view of a conventional fuel vapor treatment device in corporation with an engine and the like of an automotive vehicle.

FIG. 17 illustrates a tenth embodiment of the fuel vapor treatment device according to the present invention, similar to the fifth to ninth embodiments except for the supporting structure for the adsorbing material cartridge and omitting the air guide member. In this embodiment, the filter 43 is disposed inside the second charging chamber 25 or the second casing section of the casing 20 so as to define a chamber for the second activated carbon layer 31B. The adsorbing material formed body 90 is provided at its opposite end portions with the sealing members (or packing materials) 41, 41, and disposed in a chamber defined between the filter 43 and the first end section of the second casing section of the casing 20. Each sealing member 41 is interposed between the outer peripheral surface of the adsorbing material formed body 90 and the inner peripheral surface of the second casing section of the casing 20 so as to establish a gas tight seal between the adsorbing material formed body 90 and the casing 20. In this regard, in the fifth to ninth embodiments, the adsorbing material cartridge 90 is installed in the cylindrical wall section 95 formed integral with the casing 20, and the air guide member 174 is disposed outside of the cylindrical wall section 95 thereby forming the space for the adsorbing material or activated carbon 31 outside the air guide member 174 and within the second charging chamber 25.

Also in this embodiment, like the other embodiments, the air guide member 174 may be formed integral with the second casing section of the casing 20, and a cylindrical wall section and an atmospheric air port section formed with the atmospheric air port may be formed-separate from the casing 20, the cylindrical wall section being disposed inside the second casing section of the casing 20. In this case, the fuel adsorbing material such as activated carbon is disposed in the cylindrical wall section thereby forming the adsorbing material cartridge. Although the casing 20 has been shown and described as having the generally U-shaped gas flow passage, the shape of the casing 20 may be straight like that in the third embodiment of FIG. 6 in which the straight casing 20 is formed with the charge and purge ports 21, 22 at its axial one end and with the atmospheric air port at its axial other end, forming a straight air flow passage extending from the axial one end to the axial other end of the casing 20.

As appreciated from the above, according to the present invention, the adsorbing material cartridge whose main body section has a cross-sectional area smaller than that of the casing is disposed in the casing. Otherwise, the adsorbing material formed body having a cross-sectional area smaller than that of the casing is disposed in the casing. Therefore, the L/D value of the whole fuel vapor treatment device can be readily changed by replacing the adsorbing material cartridge or the adsorbing material formed body without re-designing and newly producing the whole body of the casing. This achieves both reduction of emission of fuel vapor to atmospheric air and improvement in production efficiency of the fuel vapor treatment device. Additionally, by providing the air guide member around the adsorbing material cartridge to form the bent gas flow passage, HC gas flows meandering along the bent gas flow passage so that its advancing direction sharply changes, and therefore diffusion of HC gas can be sufficiently retarded thereby securely suppressing emission of HC gas through the atmospheric air port into atmospheric air.

The entire contents of Japanese Patent Applications P2002-206865 (filed Jul. 16, 2002) and P2003-194096 (filed Jul. 9, 2003) are incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A fuel vapor treatment device comprising:

a casing having a charge port connected to a fuel tank, a purge port connected to an intake section of an engine, and an atmospheric air port through which atmospheric air is introduced, the casing including a part adjacent the atmospheric air port;

fuel vapor adsorbing material filled in the casing; and an adsorbing material cartridge disposed in the part of the casing and formed separate from the casing, the adsorbing material cartridge including fuel vapor adsorbing material, air introduced from the atmospheric air port being flowable through the fuel vapor adsorbing material of the adsorbing material cartridge to the fuel vapor adsorbing material in the casing.

2. A fuel vapor treatment device comprising:

a casing having a charge port connected to a fuel tank, a purge port connected to an intake section of an engine, and an atmospheric air port through which atmospheric air is introduced, the casing including a part adjacent the atmospheric air port;

fuel vapor adsorbing material filled in the casing; and an adsorbing material cartridge disposed in the part of the casing and including a cylindrical cartridge main body section having a cross-sectional area defined by an outer periphery of the cartridge main body section, smaller than a cross-sectional area defined by an inner periphery of the casing, the adsorbing material cartridge having first and second end portions which are opposite to each other, the first end portion being closer to the atmospheric air port than the second end portion, the first and second end portions being formed respectively with first and second openings, air introduced from the atmospheric air port being flowable through the first and second openings to the fuel vapor adsorbing material in the casing, fuel vapor adsorbing material being filled in the cartridge main body section.

3. A fuel vapor treatment device as claimed in claim 2, wherein the adsorbing material cartridge includes a flange formed at the second end portion of the cartridge main body section, the flange having an outer peripheral edge portion whose profile corresponds to an inner peripheral shape of the part of the casing.

4. A fuel vapor treatment device as claimed in claim 2, wherein the casing includes a cylindrical wall section connected to the part of the casing in a manner to form a step portion, wherein the adsorbing material cartridge includes a cylindrical wall section connected to the first end portion of the cartridge main body section, air introduced from the atmospheric air port being flowable through an inside of the cylindrical wall section into an inside of the cartridge main body section, the cylindrical wall section of the cartridge main body section being fixed relative to the cylindrical wall section of the casing upon contact of a part of the adsorbing material cartridge to the step portion.

5. A fuel vapor treatment device as claimed in claim 2, further comprising a cylindrical air guide member fixedly disposed outside a major part of the cartridge main body section and having first and second end portions which are opposite to each other and located respectively adjacent the first and second end portions of the cartridge main body section, the first end portion of the air guide member being fixed to the part of the casing and formed with an opening in which the cartridge main body section is located, the second end portion of the air guide member being closed so as to define a space between the air guide member and the cartridge man body section, the space being in communication with the inside of the cartridge main body section and with the inside of the part of the casing.

6. A fuel vapor treatment device as claimed in claim 2, wherein the fuel vapor adsorbing material is at least one selected from the group consisting of pellet-type fuel vapor adsorbing material and a honeycomb-shaped monolithic body of the fuel vapor adsorbing material.

7. A fuel vapor treatment device comprising:

a casing including first and second casing sections, the first casing section having a charge port connected to a fuel tank, and a purge port connected to an intake section of an engine, the second casing section having an atmospheric air port through which atmospheric air is introduced;

fuel vapor adsorbing material filled in the first and second casing sections of the casing;

an adsorbing material cartridge disposed in a part of the second casing section which part is adjacent the atmospheric air port, the adsorbing material cartridge including a cylindrical cartridge main body section having a cross-sectional area defined by an outer periphery of the cartridge main body section, smaller than a cross-sectional area defined by an inner periphery of the part of the second casing section, the adsorbing material cartridge having first and second end portions which are opposite to each other, the first end portion being closer to the atmospheric air port than the second end portion, the first and second end portions being formed respectively with first and second openings, air introduced from the atmospheric air port being flowable through the first and second openings to the fuel vapor adsorbing material in the first and second casing sections, fuel vapor adsorbing material being filled in the cartridge main body section; and a cylindrical air guide member fixedly disposed outside a major part of the cartridge main body section and having first and second end portions which are opposite to each other and located respectively adjacent the first and second end portions of the cartridge main body section, the first end portion of the air guide member being fixed to the second casing section and formed with an opening in which the cartridge main body section is located, the second end portion of the air guide member being closed so as to define a space between the air guide member and the cartridge main body section, the space being in communication with the inside of the cartridge main body section and with the inside of the second casing section.

8. A fuel vapor treatment device as claimed in claim 7, wherein the casing includes a cylindrical wall section connected to the part of the second casing section in a manner to form a step portion, wherein the adsorbing material cartridge includes a cylindrical wall section connected to the first end portion of the cartridge main body section, air introduced from the atmospheric air port being flowable through an inside of the cylindrical wall section into an inside of the cartridge main body section, the cylindrical wall section of the cartridge main body section being fixed relative to the cylindrical wall section of the second casing section upon contact of a part of the adsorbing material cartridge to the step portion.

9. A fuel vapor treatment device as claimed in claim 7, wherein the fuel vapor adsorbing material is at least one selected from the group consisting of pellet-type fuel vapor adsorbing material and a honeycomb-shaped monolithic body of the fuel vapor adsorbing material.

10. A fuel vapor treatment device comprising:

a casing including first and second casing sections, the first casing section having a charge port connected to a fuel tank, and a purge port connected to an intake section of an engine, the second casing section having an atmospheric air port through which atmospheric air is introduced;

fuel vapor adsorbing material filled in the first and second casing sections of the casing;

a cylindrical wall section extending from a part of the second casing section which part is adjacent the atmospheric air port into the second casing section, the cylindrical wall section having a first end portion connected to the part of the second casing section, and a second end portion through which air is flowable, the cylindrical wall section having a cross-sectional area defined by an outer periphery of the cylindrical wall section, smaller than a cross-sectional area defined by an inner periphery of the part of the second casing section;

an adsorbing material cartridge disposed inside the cylindrical wall section, air introduced from the atmospheric air port being flowable through the adsorbing material cartridge to the second end portion of the cylindrical wall section; and a cylindrical air guide member fixedly disposed outside a major part of the cylindrical wall section and having first and second end portions which are opposite to each other and located respectively adjacent the first and second end portions of the cylindrical wall section, the first end portion of the air guide member being fixed to the second casing section and formed with an opening in which the cylindrical wall section is located, the second end portion of the air guide member being closed so as to define a space between the air guide member and the cylindrical wall section, the space being in communication with the inside of the cylindrical wall section and with the inside of the second casing section.

11. A fuel vapor treatment device as claimed in claim 10, wherein the cylindrical wall section is integral with an inner wall surface of the part of the second casing section.

12. A fuel vapor treatment device as claimed in claim 10, further comprising an atmospheric air port section formed with the atmospheric air port, the atmospheric air port section being integral with the second casing section and having an inner wall surface from which the cylindrical wall extends into the second casing section.

13. A fuel vapor treatment device as claimed in claim 10, wherein the adsorbing material cartridge includes a cartridge main body section which is a honeycomb-shaped monolithic body of the fuel vapor adsorbing material.

* * * * *